US007889075B2

(12) United States Patent
Winkler et al.

(10) Patent No.: US 7,889,075 B2
(45) Date of Patent: Feb. 15, 2011

(54) PERIMETER PROTECTION SYSTEMS

(76) Inventors: Gregory Robert Winkler, 13971 Quail Ridge Dr., Broomfield, CO (US) 80020; Reginald John Kerr, 9850 N. Shore Rd., Cuba, NY (US) 14727

( * ) Notice: Subject to any disclaimer, the term of this patent is extended or adjusted under 35 U.S.C. 154(b) by 268 days.

(21) Appl. No.: 11/877,555

(22) Filed: Oct. 23, 2007

(65) Prior Publication Data

US 2008/0106408 A1 May 8, 2008

Related U.S. Application Data

(60) Provisional application No. 60/862,739, filed on Oct. 24, 2006.

(51) Int. Cl.

| | |
|---|---|
| ***G08B 13/00*** | (2006.01) |
| ***G08B 13/12*** | (2006.01) |
| ***G08B 13/08*** | (2006.01) |
| ***E04H 17/02*** | (2006.01) |

(52) U.S. Cl. ..... 340/550; 340/545.2; 340/548; 340/541; 340/565; 340/566; 256/39; 256/46

(58) Field of Classification Search ..... 340/550, 340/541, 540, 500, 564; 256/32–58
See application file for complete search history.

(56) References Cited

U.S. PATENT DOCUMENTS

| | | | | |
|---|---|---|---|---|
| 3,790,944 | A * | 2/1974 | Yarwood | 340/545.9 |
| 4,683,356 | A * | 7/1987 | Stoler | 200/61.93 |
| 4,839,632 | A * | 6/1989 | Zahn et al. | 340/550 |
| 5,274,357 | A * | 12/1993 | Riordan | 340/550 |
| 5,371,488 | A * | 12/1994 | Couch et al. | 340/541 |
| 5,392,027 | A * | 2/1995 | Brunot et al. | 340/561 |
| 5,852,402 | A | 12/1998 | Perry | |
| 5,900,815 | A * | 5/1999 | Story | 340/548 |
| 5,943,294 | A | 8/1999 | Cherek et al. | |
| 6,058,816 | A | 5/2000 | Golioto | |
| 7,088,276 | B1 | 8/2006 | Wegener | |
| 7,292,145 | B2 * | 11/2007 | Castle et al. | 340/545.6 |
| 2004/0166883 | A1 | 8/2004 | Kim et al. | |
| 2005/0167644 | A1 * | 8/2005 | Deupree | 256/32 |

* cited by examiner

*Primary Examiner*—Daniel Wu
*Assistant Examiner*—Pameshanand Mahase
(74) *Attorney, Agent, or Firm*—Marsh Fischmann & Breyfogle LLP

(57) ABSTRACT

A detection system comprising a plurality of taut wire panels having vertical detection/sensor wires. The sensor wires are tensioned to position trigger plates associated one or more of the wires. Trigger plate movement causes an actuating means to indicate a sensor wire has been moved. In one embodiment, sensor wires and portions of the panel frame have similar coefficients of thermal expansion to substantially eliminate environmental expansion effects that may result in false alarms. Linked sensor wires on adjacent panel may signal movement of entire panels. Panels are monitored by panel controllers reporting to sector controllers that report to a central command computer that automatically numbers sector and panel controllers at start-up. Bi-directional communication enables alarms and system faults to be precisely located.

10 Claims, 16 Drawing Sheets

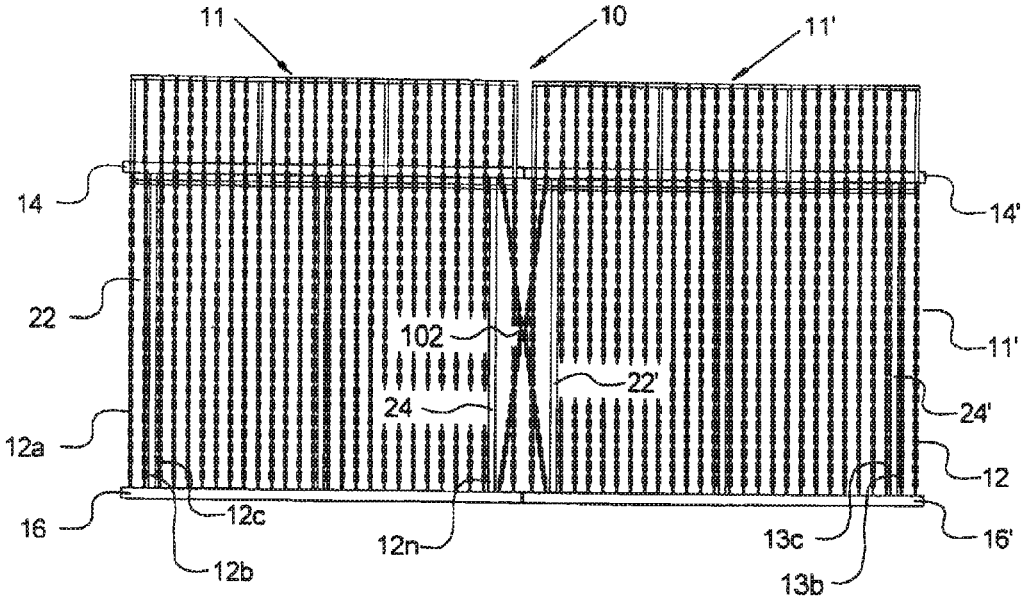
Fig. 1a
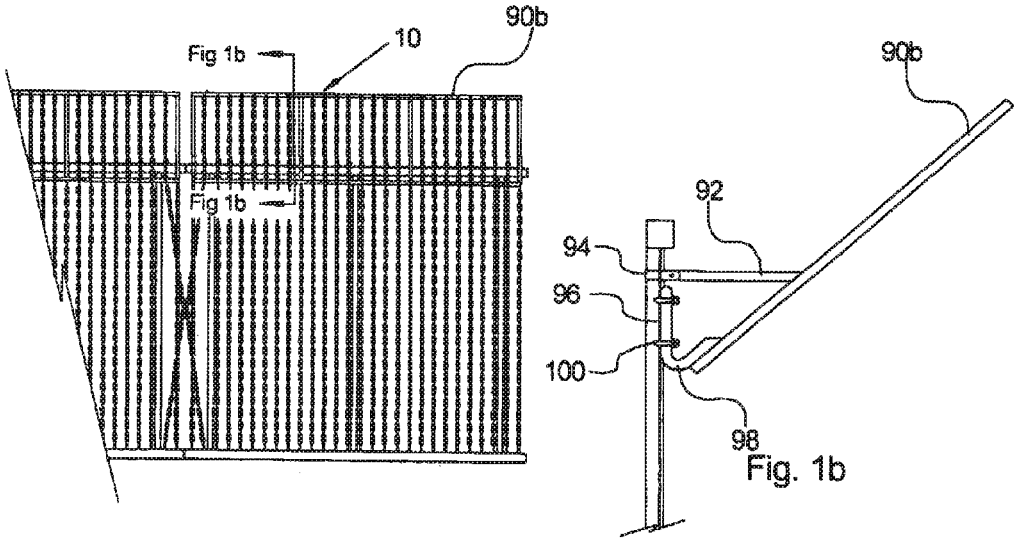
Fig. 1b
Figure 1

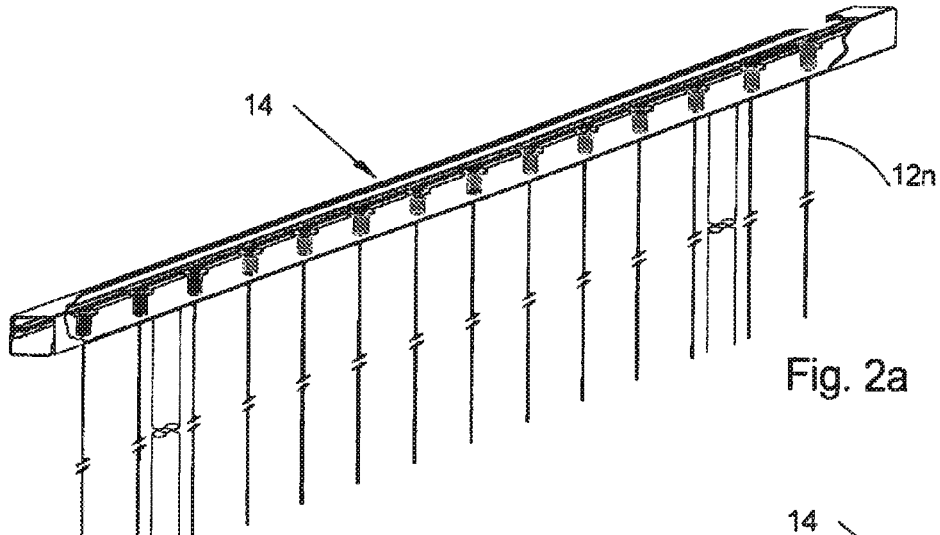
Fig. 2a
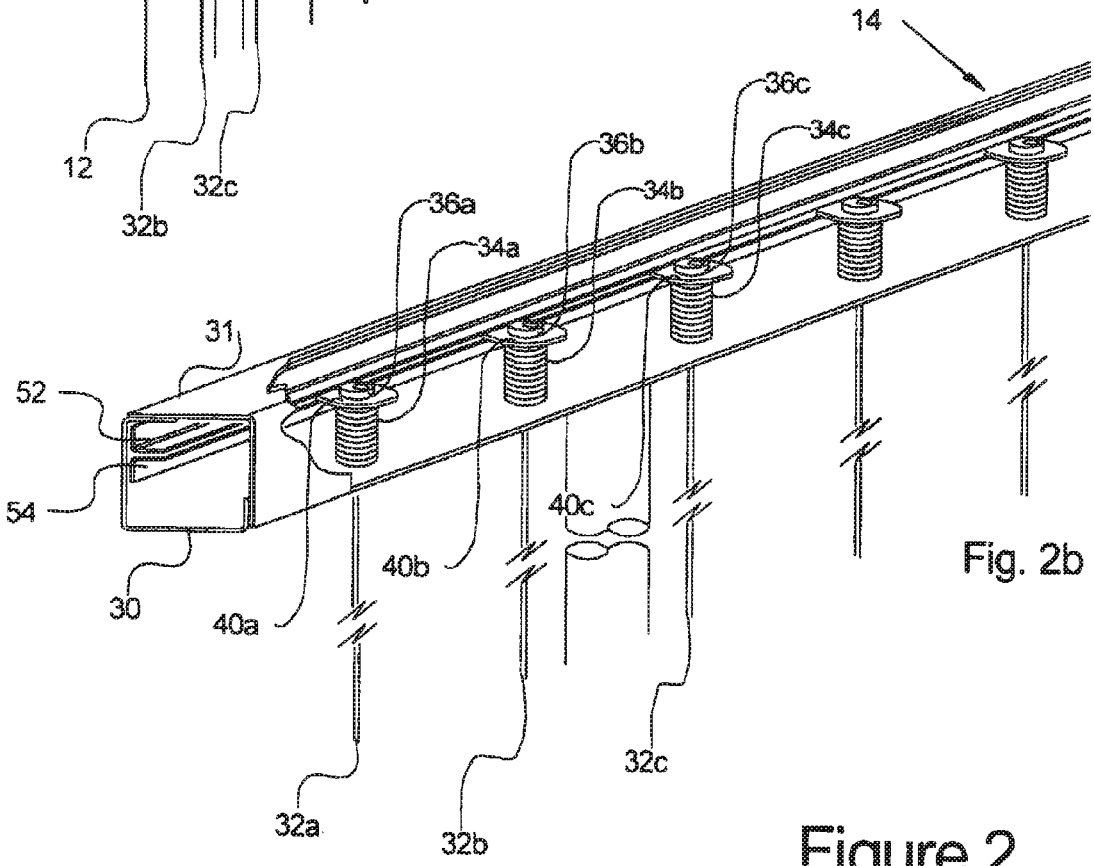
Fig. 2b
Figure 2

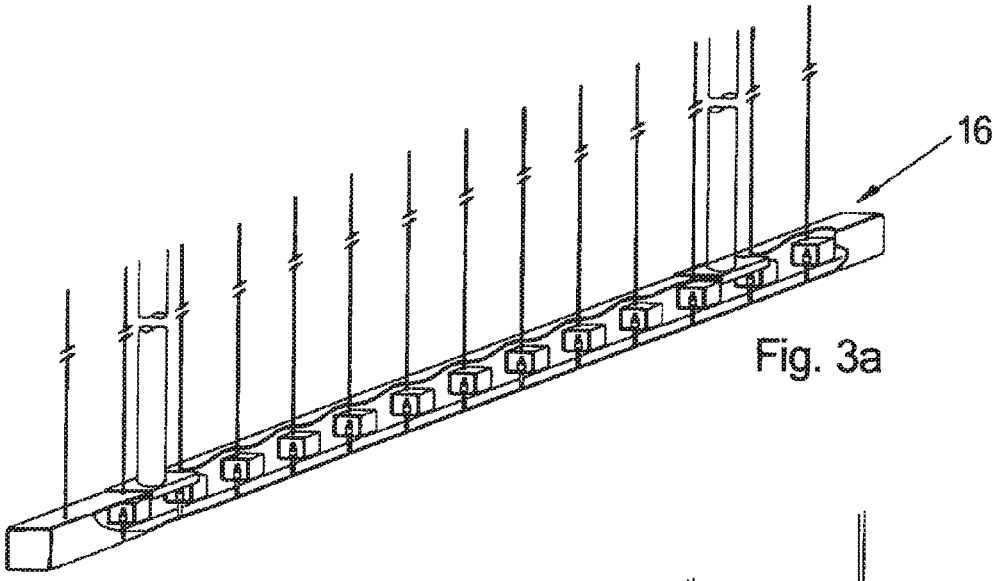
Fig. 3a
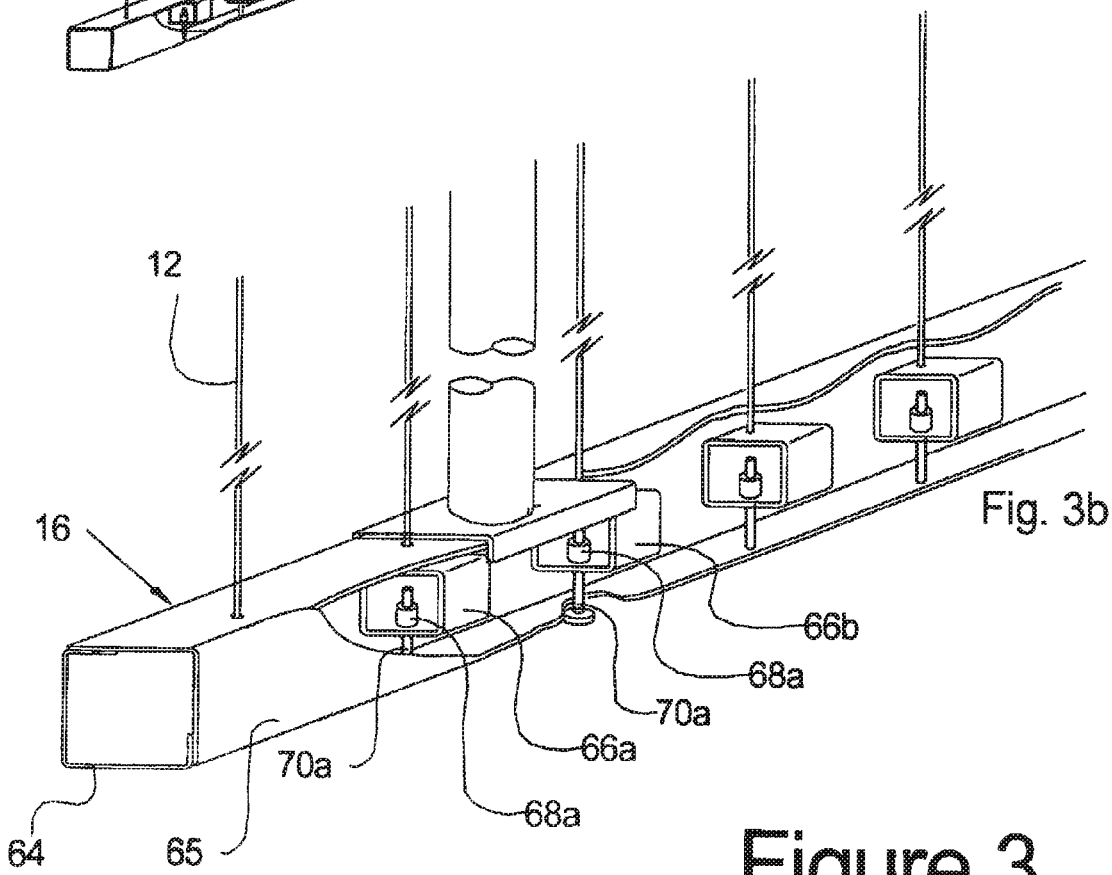
Fig. 3b
Figure 3

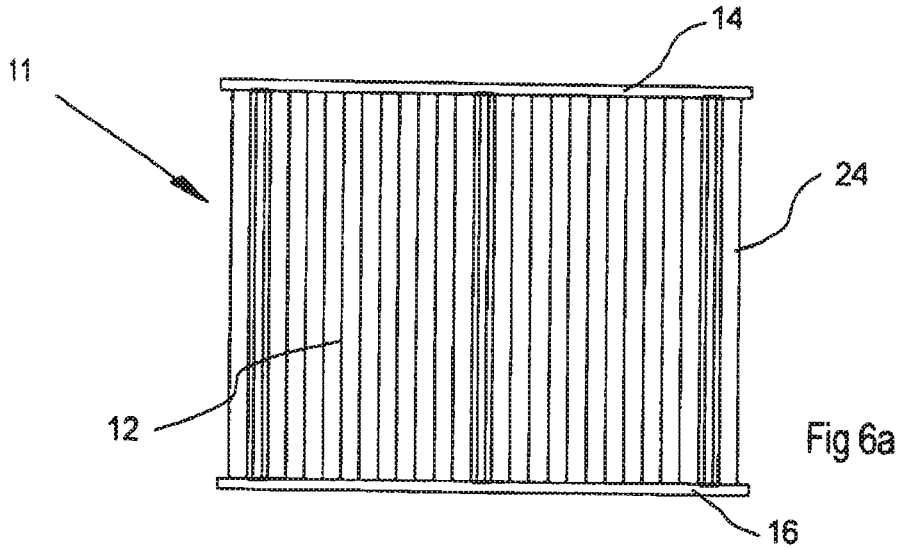
Fig 6a
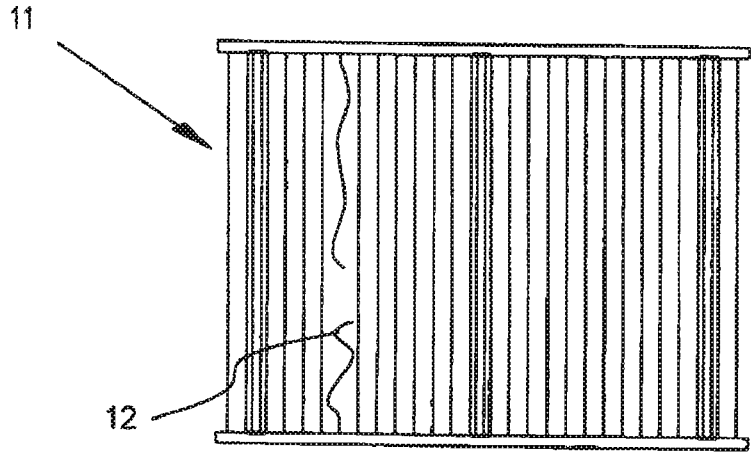
Fig 6b
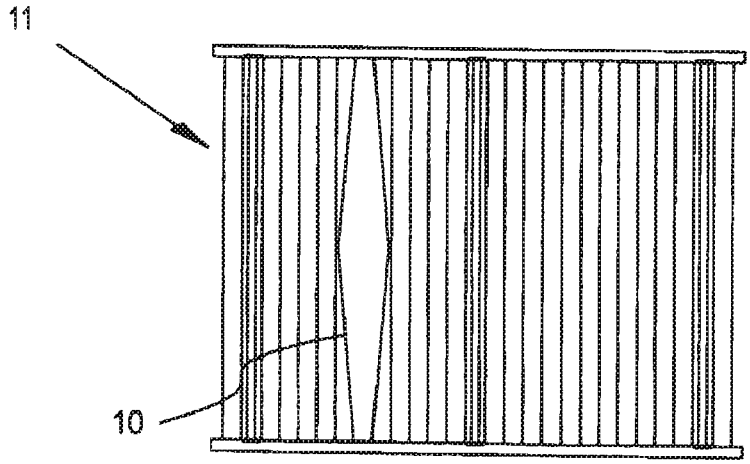
Fig 6c
Figure 6

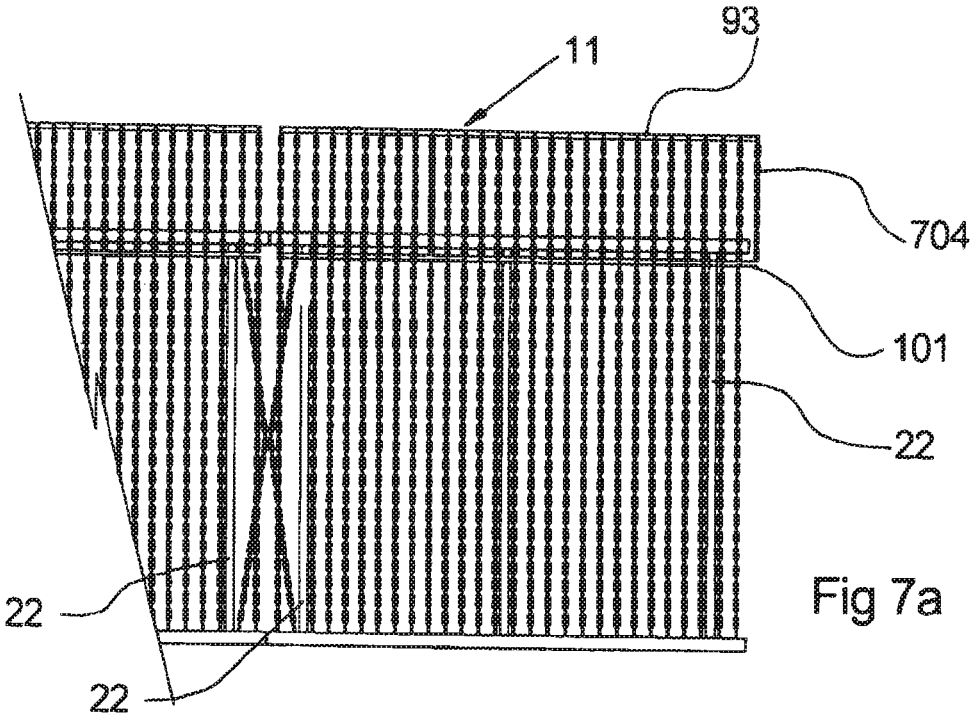
Fig 7a
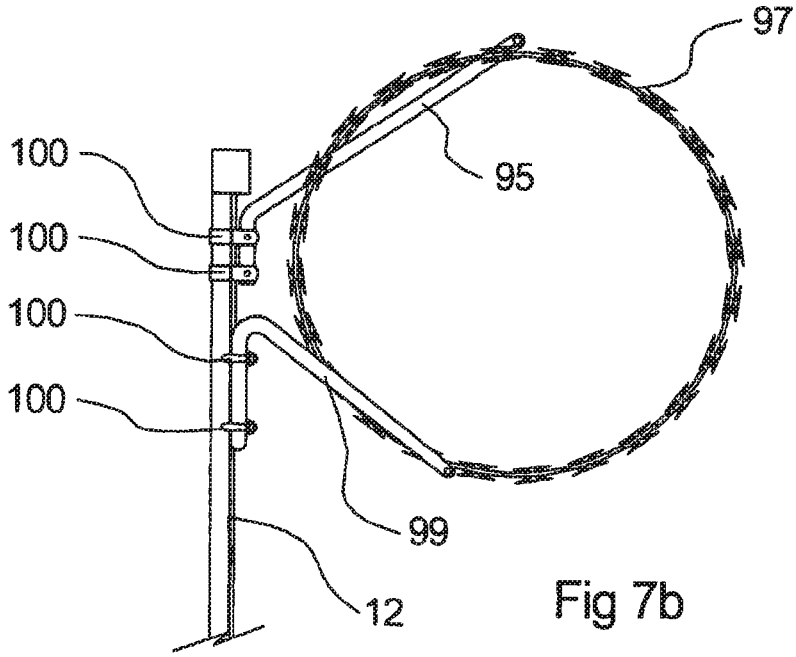
Fig 7b
Figure 7

PERIMETER PROTECTION SYSTEMS

CROSS REFERENCE

This application claims the benefit of U.S. Provisional Application No. 60/862,739, entitled "MOTION DETECTION APPARATUS AND METHOD SECURITY SYSTEM," having a filing date of Oct. 24, 2006, the entire contents of which are incorporated herein by reference.

FIELD

The present inventions are directed toward perimeter security system and methods for detecting physical moment. More specifically in one aspect a modular taut wire fencing system is provided for detecting movement and in another aspect a flexible linear sensor system is provided for detecting movement of a fence or other structure to which the sensor is attached.

BACKGROUND

It is recognized that a wide variety of configurations of perimeter security fencing are required in order to service the many terrains to be followed, shapes to be enclosed and fence types utilized. For example, it is well known that existing taut-wire security systems provide a formidable barrier using multiple, closely spaced, horizontal barbed/razor wires. Such systems may provide for detection capability, wherein movement of one or more of the wires may "trip" a motion sensor and provide an indication of an attempted intrusion. Such a detection capability may be provided so long as the system is meticulously installed in flat and level locations and is operating in moderate weather conditions Cost factors normally result in taut-wire systems being configured to provide a series of straight sections about 160 feet long between anchor posts with sensor posts located centrally between anchor posts. Further, intermediate taut wire support devices and posts may be located at 10-foot intervals between the anchor and sensor posts. Horizontal barbed wires, spaced vertically a few inches apart, are stretched, typically with about 70 pounds of tension, between the anchor posts. The normal quantity of these horizontal taut wires is 30 or more resulting in overturning forces of more than 2000 pounds at each anchor post. Accordingly, the anchor and corner posts for these systems require massive and expensive structural concrete foundations to resist the high side loads imparted on them by the tension forces of the horizontal taut wires.

Such existing taut wire systems also have a very limited capability to traverse vertical grade changes, and, due in part to the length of the taut wire runs, experience significant changes in taut wire tension due to temperature variations and support post movements caused by effects such as frost heave. Such variations are compensated for by using mechanical and/or electronic design features within the sensor mechanisms. These compensating mechanisms may compromise the validity of the detection mechanism by slowing the response of, and/or desensitizing, the motion sensors attached to the wires.

It is also well known that horizontal taut wires are compromised by ice and snow build-up causing taut wire systems to generate false alarms in winter conditions. Many existing systems will only work with the sensors installed in a vertical position extending between the horizontal wires and many existing sensors are also subject false alarms generated by electromagnet and radio frequency interference and suffer sensitivity changes due to temperature changes.

Detection of attempts to breach the fence in existing taut wire systems are typically localized to within the 160 feet between anchor posts. Detection of intrusions at or near the anchor posts can only result from the fracture of anchor tabs to which the taut wires are attached. These tabs are deliberately designed to break when the vertical force on the taut wire, as generated by an intruder or other means, exceeds the design fracture limit of the tab. Activation of the system by this means typically destroys the anchor tab and in most cases destroys the sensor thus requiring significant repairs to the system following a detected intrusion.

The sensitivity to motion of each horizontal taut wire in existing systems varies tremendously along the length of the taut wires between anchor posts and sensor posts ranging from reasonably high near the sensor post(s) to virtually nothing near the anchor posts. In order to maintain some semblance of uniform sensitivity on these known systems it is often required that substantial overlaps are provided at the anchor points of fence sections and at the fence corners.

Areas of a perimeter not suited to the installation of taut wire have been at least partially protected using microphonic security systems. Such systems may utilize the triboelectric effect of some coaxial cables to provide intrusion detection when the cables are attached to, for example, chain link or other fences. Accordingly, such systems can follow can follow most terrain variations. The coaxial sensor cables in these systems are detecting audible sounds, normally centered on the 400 Hz to 800 Hz range, These are secondary sounds generated by movements of the fence fabric to which the cables are attached.

These systems utilize various features of the incoming noise in the 400 Hz to 800 Hz range such as amplitude, duration and pulsing to try to determine if a human intrusion is taking place. Typically these systems will register an intrusion alarm when the detected secondary frequency amplitude exceeds a predetermined threshold for a predetermined time or if the amplitude threshold is exceeded for a shorter time a set number of times over a predetermined timeframe such as 4 to 10 times per minute. Using such determinations based upon secondary frequency sound sources leaves the system prone to misdiagnosis of such frequency as human intrusion when in fact they are generated by environmental inputs such as wind and rain.

However, the audible signals in the described 400 Hz to 800 Hz are secondary signals generated by different primary higher, lower and equal frequencies of motion applied to the fence which cause the metallic components of the fence to impact each other thus generating the aforesaid secondary frequencies. It has further been found that while standard galvanized wire chain link fences generate these high amplitude secondary frequency sounds, in response to fence fabric movement, vinyl coated chain link fence fabric generates such a low amplitude of secondary frequency sounds that the existing systems do not work with such fence fabrics. These secondary frequencies may also be generated by many extraneous environmental effects, man-made vibration sources (e.g., heavy traffic) as well as by human intrusion. The determination as to if a signal is generated by human intrusion or an environmental effect is problematic at best.

Stated otherwise, while these systems have a reputation for reasonable detection capability in clear calm environmental conditions, inclement weather such as rain, hail and wind, often generates false alarms in such systems. The technique currently used to eliminate these false alarms is to detect the adverse conditions and to reduce the system sensitivity such that the systems ignore the environmental conditions. In most cases this reduction of sensitivity will render such systems inoperable during poor weather conditions.

Further a trained intruder may defeat a microphone security system by circumventing other built in false alarm rejection means. Often these microphonic systems utilize a signal count method of rejecting high magnitude, apparently spurious, signals. The system will allow a predetermined number of short duration high magnitude signals from the fence within a preset time limit without generating an alarm. If the system is pre-set to allow 3 or 4 such signal inputs before tripping the alarm then an intruder can make a limited number of attacks (e.g., two) on the fence (such as cutting the chain link fabric) and then wait a suitable time (usually about sixty seconds) for the system to reset at which point more attacks can be made. A few minutes of such specific attacks can allow an intruder to gain entry.

The two types of systems described thus far are typical of the many different types of system used on high security perimeter fence lines. In addition, there are many different technologies used such as infrared beams, microwave beams, electrostatic fields both above and below ground. Any of these systems may be deployed along a perimeter and usually require one or more of the other systems in an attempt to cover the insensitivities or environmental failings of each other.

Typically on a large high security perimeter there are two parallel fences with a wide no-mans-land area between them. Each fence will be protected by a different type of security system while the gap between the fences may be protected by some type of volumetric security system. This results in a complexity of high maintenance equipment with suspect reliability that relies extensively on human supervision, especially in inclement weather conditions and covers a large area of real estate.

SUMMARY

The present inventions relate to systems and methods (utilities) that may alone or in combination provide an uninterrupted chain of intrusion detection around a secured area. The various utilities may be utilized to detect intrusions by people across a secured perimeter in any plane or direction. That is, the various utilities may be used to detect attacks by people attempting to enter a secure area or likewise to detect excursions from a controlled area. In one aspect, various utilities utilize a flexible linear detection means attached to a non-rigid barrier means to identify such intrusions/extrusions. Such detection means may be networked with a common control and operating system that uses inputs from a plurality of sensor types each selected to suit the local characteristics and topography of specific sections of any perimeter. In another aspect, various utilities detect motions generated by intrusions that cause the displacement of pre-tensioned wires within a modular frame. This aspect may further utilize a flexible linear sensor means for converting primary physical displacement, motions and vibrations of a non-rigid barrier, such as coiled barbed wire, tape barrier or chain link fencing, generated by an attempted intrusion/extrusion. This aspect may also utilize razor wires to provide an imposing modular barrier with or without utilizing motion detection sensors. Another aspect of the invention relates to system sensors for converting motions and vibrations into electrical responses in an electronic circuit and to the digitized signal processing portion of such apparatus that can accept and interpret any such electrical responses into an intrusion alarm signal means.

In this document, a motion detection sensors and associated programming for use in security systems are provided with a plurality of discrete motion signal detection means used to determine the presence of preprogrammed motions or groups of motions normally generated by intrusion attacks on a specific type of perimeter barrier or fence. These motions are converted into electrical signals proportional to the motion frequency and amplitude or as signals indicative of change of position of pre-tensioned wire position and these signals are transmitted to digital signal analyzers.

The utilities utilizing vertical pre-tensioned wires within a modular frame provide a number of advantages over existing systems. These advantages include greater precision intrusion location than traditional horizontal taut wire systems. The vertical wires when constructed from Razor or Barbed wire provide a visual and physical deterrent to intrusion. However, the use of smooth vertical wires terminating in upper and lower rails integrated with support fence posts results in a far more pleasing and less intrusive or threatening system than the horizontal barbed wires and spiral intermediate supports, sensor posts and anchor posts of conventional taut wire systems.

In one aspect of the invention, a barrier system includes a number of modular barrier panels each comprising a plurality of vertical wires tensioned between two horizontal rails kept separated by vertical support columns. The modular panels may be installed at any angle, however, for convenience in this description the wire restraining rails are referred to as upper and lower horizontal rails while the support columns are referred to as vertical support columns and the pre-tensioned wires as vertical pre-tensioned wires. The lower rail may form a passive restraint used to capture, locate and adjust the lower end of the individual vertical wires. The upper rail may provide the other passive restraint to keep the individual vertical sensor wires tensioned by providing a non-movable structure against which the individual vertical wires apply pressure. In one arrangement, the upper rail may include a plurality of springs to keep the wires tensioned. In a further arrangement, a plurality of trigger devices may be utilized. For instance, each trigger device may be associated with one wire. Movement of that wire may result in the trigger device altering the state of an electrical circuit. By monitoring the electrical circuit and identifying the change of state, movement of a wire(s) of a panel may be identified, which may signify an attempted infusion.

In one arrangement, the rails may be hollow in order to house, for example, springs, sensors and trigger devices etc. In one arrangement, attached inside the upper horizontal rail are two, light weight (i.e. low inertia), pivoting, horizontal strips mounted on hinge pins or other pivoting fixtures. Such strips may be installed above and below individual trigger devices respectively mounted to the top of each sensor wire. The horizontal strips are kept in contact with the trigger devices by springs mounted around hinge pins of the strips. A downward force on an individual or several taut wires, as for example, by moving a single taut wire to one side or spreading apart two adjacent taut wires (such motions are those generated by an attempt to pass through the barrier) will cause a downward motion of the upper end of the taut wire(s). This motion is transmitted by the attached trigger device to the lower pivoted strip causing it to rotate downwards. The motion of the pivoted strip is detected by suitable means of motion detection such as a snap action switch, connected to generate an alarm signal in the event of such motion.

Conversely, cutting one of the vertical wires may allow a tensioning spring associated with the wire to move upward such that the trigger device moves upwards, causing the upper strip to rotate. This motion is also detected by a suitable means of motion detection, again, for example, a snap action switch, thus generating in similar fashion a separate alarm signal for wire cutting intrusions.

It will be appreciated that an attempt to climb the vertical taut wires is a very difficult proposition due to the difficulty of gripping the thin wires that do not provide the ladder like formation of previous horizontal taut wire systems. However, if a method is found to provide grip on the sensor wire such an attempt will apply downward force on the vertical sensor wire. These forces will overcome the spring tension in the wires and generate alarms in the same manner as the forces applied to the taut wires by moving them horizontally (i.e. spreading motion).

The sensor panels in accordance with the invention eliminate false alarms due to temperature changes by allowing the detection means at the top of the taut wires to move at the same rate and direction as the taut wires move when the panel is subjected to temperature variation. This is achieved by manufacturing the sensor wires and the vertical support columns from materials with equal or near equal coefficients of linear expansion due to temperature changes. When used as a fence system the vertical sensor wire design virtually eliminates false alarms caused by snow and ice build-up during winter conditions.

The reduced mass of metallic components used in the present system, when compared with conventional taut wire systems, allows for the use of stainless steel wires and components without a prohibitive cost penalty.

The design of the system in accordance with one exemplary embodiment, of the invention uses on/off" signal technology that can be achieved using standard snap action switches. This solution for alarm generation allows easy sensitivity adjustment during assembly by mechanical adjustment of snap action switch positions and less complex software control due to there being no requirement for A/D conversions or environmental compensation controls.

Because each sensor panel of this system, attached to and located between perimeter fence line posts, has it's own separate detection means, the accuracy of detection is determined by the length of the individual sensor panels that can be, for example and without limitations, 4 to 12-feet wide. The system disclosed herein can therefore position an intrusion signal within a 4 to 12-foot section of the perimeter fence or any combination of these dimensions as provided by the central control software. Longer zones of detection accuracy can be achieved by combining the outputs of two or more fence sensor panels within the software commands in the central control computer.

The panels of vertical pre-tensioned wires within a modular frame disclosed herein does not require horizontal tensioning since all tensioning requirements are provided within each modular frame structure thereby reducing both line and corner post sizes and post foundation size. Installation is fast and simple due to the modular panel design. The repeatable modular design may also reduce manufacturing costs.

To overcome the problems of providing intrusion detection on coiled barbed wire or tape attached to a perimeter fence line, or, to a chain link fence spanning difficult topography. Another aspect of the invention is directed to a flexible linear sensor control invention that includes signal-processing circuitry for use in an intrusion detection system that provides both flexibility and adaptability to many different intrusion detection situations. Such linear sensors include, without limitation, microphonic sensors and/or coaxial cables. What is important is that each sensor be connectable to a fence to detect vibrations and motions and generate a signal indicative thereof. This aspect may also provide an automatic means for rejecting a multiplicity of signals that would otherwise trigger a false alarm, which are caused by a general increase in the prevailing level of noise or vibration in the vicinity of the sensor or sensors used.

In one utility, a number of signal analyzers are provided each including a bandpass filter tuned to a selected frequency range. Each filter receives the output of a least one of the sensors used for the system. In one arrangement, a single sensor output is split into multiple frequency ranges for individual monitoring. The output can be received direct from the sensor or via intervening signal processing circuitry. In this regard, it is to be understood that it is conventional in the electrical design arts to include a variety of circuit elements having discrete functions that may be desirable or even necessary to proper operation of the system. For example, if the output signal from the filter has to travel a long distance before reaching the remaining signal-processing circuitry, it may be desirable to incorporate an amplifier for the signal in the vicinity of the filter so that the strength of the amplified signal at the input of the rest of the signal-processing circuitry is adequately high. Further, when designing a monitored circuit, a designer may elect to provide conventional signal-modifying circuit elements, e.g. power line frequency rejection notch filters, preamplifiers, delay or equalizing circuits, variable gain controls, etc. as may be suitable.

Each bandpass filter is accordingly responsive to sensed movement having vibration frequency components within the associated passband. The attached signal analyzers each provide an initial affirmative output signal if the amplitude of the input signal within the associated frequency range exceeds a predetermined level for a predetermined time interval.

The threshold amplitude level at which an output affirmative signal is generated by the signal analyzer can, if desired, be varied in response to prevailing ambient noise or any other criterion selected by the circuit designer. To this end, the utility may include a threshold adjustment circuit receiving an output signal from one or more of the bandpass filters which receives a sensed signal. This threshold adjustment circuit raises the threshold level above which an output affirmative signal is produced by one or more other bandpass filters in response to an increase in ambient noise.

Because the intrusive movement is reflected in several frequency bands, then for increased rejection of false alarms, it may be desirable to combine the various bandpass filter outputs into a logic circuit in order to establish whether the pattern of detected signal frequency components corresponds to patterns that are known or expected by the designer to be associated with unwanted human intrusion. Equally, one or more output affirmative signal could be used for the purpose of adjusting the threshold of some or all of the other channels or even for rejection of the initial affirmative signals that otherwise might combine to generate an false alarm.

Intruder generated displacement of the sensor means generate motions and vibrations that vary from sub-sonic to supersonic. The input signals vary from the cutting of a wire that generates signals within and above the audible range to the climbing of a fence that generates signals from below to within the audible range all of which can be detected by the taut wire or linear detection systems described herein. Additionally, very slow displacement attacks with barrier wires moving only inches over a time frame of minutes are readily detectable by the modular pre-tensioned sensor wire system described herein.

In one exemplary embodiment such signals are transmitted to the digital signal analyzers either as AC waveforms, resistive changes or dry contact changes. Fixed band-pass filters located on the digital signal analyzer inputs eliminate unwanted noise and inappropriate signals. Each signal analyzer is therefore only responsive to frequencies within the associated filter pass-band frequency settings. The original unfiltered signal input that is generated by a variety of sensor devices is passed through an adjustable amplitude control that may only allow through any increase in signal strength that exceeds a preselected threshold at a preprogrammed rate of rise. This control may also be configured to modify the rate of reduction of allowable amplitude of the input signal at an adjustable rate. This feature provides the system with an adaptive logic control that will change the system sensitivity to better cope with surreptitious forms of attack and to reject environmental interference.

The analysis of the signal input, one exemplary embodiment, may begin when the amplitude of the input signal exceeds the adjustable rate of rise threshold level. When activated the signal analyzer determines when the signal exceeds an adjustable predetermined amplitude level for an adjustable predetermined length of time. If the predetermined parameters of amplitude are not maintained for the predetermined time then the signal analyzer turns off and awaits the next input signal. If the predetermined amplitude and time parameters are met the signal analyzer generates a preliminary alarm signal. The outputs of all of the signal filters and analyzers are entered into a logic formula that provides a final output alarm signal when a predetermined combination of preliminary alarm signals is received from the signal processors.

BRIEF DESCRIPTION OF THE DRAWINGS

FIG. 1*a* is a front view of a section of a sensor system showing two modular panels in accordance with one embodiment of the invention.

FIG. 1*b* is a side view showing an outrigger frame extending from the modular panels FIG. 2*a* is a broken perspective view of the upper rail of the panel in accordance with one embodiment of the invention.

FIG. 2*b* is an enlarged perspective view of a segment of an upper rail with the cover broken to show the interior in accordance with one embodiment of the invention.

FIG. 3*a* is a broken perspective view of a lower rail of the panel in accordance with one embodiment of the invention.

FIG. 3*b* is an enlarged view of a segment of the lower rail with the cover broken to show the interior arrangement in accordance with one embodiment of the invention.

FIGS. 6*a*, 6*b* and 6*c* illustrate various conditions of a sensor wire or wires in non-alarm and in alarm conditions of a modular panel in accordance with one embodiment of the invention.

FIGS. 7*a* and 7*b* show an alternate embodiment of the outrigger using barbed coils instead of the frame shown in FIG. 1*a* and FIG. 1*b* in accordance with one embodiment of the invention That uses the flexible linear detection means to provide security at the barbed coils.

DETAILED DESCRIPTION

Figure 4:
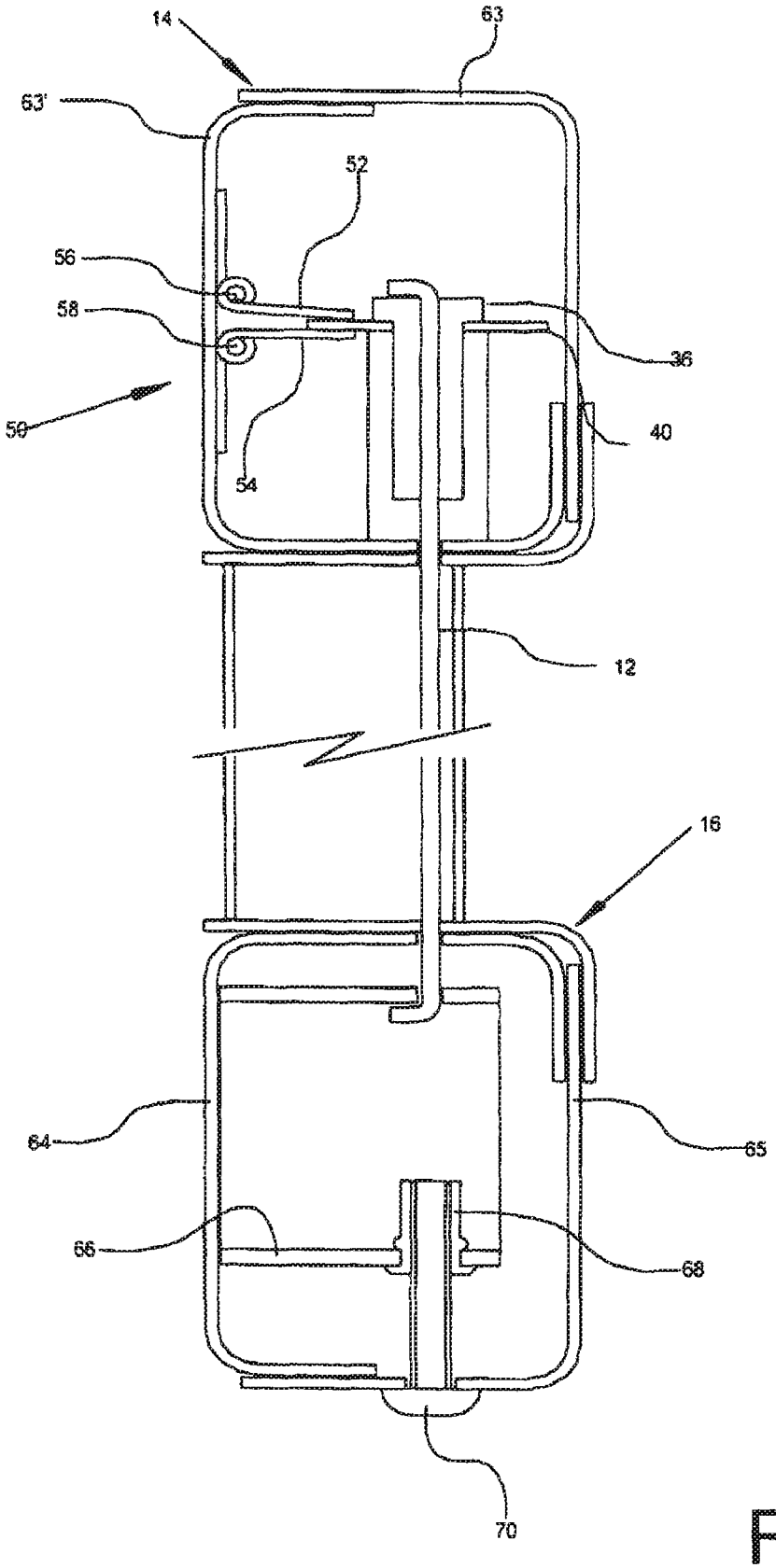
FIG. 4 is a side view cross section of a modular panel in accordance with one embodiment of the invention.

FIG. 1*a* illustrates a vertical wire security barrier fence 10 in accordance with one aspect of the invention. In the illustrated embodiment, each panel 11 of the fence 10, includes a plurality of vertical wires 12*a-n* of each panel 11 tensioned between two horizontal rails 14 and 16, as described in more detail in FIGS. 2*a*, 2*b*, 2*c* and 2*d*. It will be appreciated that wires 12, etc. shown in FIG. 1*a* are razor wire, desirable in many cases for maximizing physical deterrence, but when aesthetic considerations are paramount and herein for ease of illustration, the wires indicated in FIG. 2 are shown as smooth wire. Typically a smooth, commercially available, hardened, 14 gauge (0.078 inches diameter) stainless steel wire could be used for this purpose. The vertical taut wires 12 may in one embodiment be spaced from 3 to 4 inches apart along the horizontal rails 14 and 16. The horizontal rails 14 and 16 are rigidly spaced and supported by end posts 22 and 24, as seen in FIG. 1*a*. The end posts 22, 24 and the horizontal rails 14, 16 of each panel 11 are in one embodiment sized to form a barrier 8 to 10 feet wide by 8 to 12 feet high as desired. It will be understood that the panel may be sized to greater or lesser dimensions as desired, but the nominal size described here is easily transported in common carriers. If the panel is of sufficient size, extra posts such as a third post, may be placed between the two end posts 20 and 22 to further stabilize the panel 11. In connection with adjacent panels, the end posts can be positioned so that there are sensor wires on each side.

As seen in FIGS. 2*a* and 2*b* as well as in FIG. 4, the upper rail 14 comprises a lower angle-piece 30 and an upper angle piece 31 that collectively form a housing that houses the trigger mechanism/motion detection switches for each panel. The lower angle piece provides a non-movable structure or shelf to which the individual vertical sensor wires 12*a-n* (hereafter collectively wires 12, unless individually referenced) apply pressure, for example, via respective tensioning springs 34*a-n* that may be captured at the end of each spring, by means such as sensor wire retainers 36*a-n* that receive individual wires 12, which are bent at the end to prevent their slipping through the holes in the retainers. At the upper end of each of the wires or springs are disposed respective trigger plates 40*a-n* resting on the tops of springs 34*a-n* and captured by lips on retainers 36*a-n*. It will be seen in FIG. 4, which corresponds generally to the elements shown in FIGS. 2*a*, 2*b*, 3*a*, and 3*b*, that the individual trigger plates 40 are held in position by the tension in the wires 12 created by springs 34 against the lower angle-piece 30 of the rail 1412. As will be discussed herein, each trigger plate is disposed proximate to a switch, such that movement of the wire 12 results in tripping of the switch.

While it will be understood that each respective trigger plate, 40 could actuate individual switches (e.g., snap-action switches), or the like, to indicate movement of an attached wire, that the present embodiment utilized a switch that is connected to multiple wires. Such an embodiment provides a number of benefits, including ease of adjustment and economy of manufacture. This multi-wire switch mechanism 50 is located inside the upper horizontal rail 14.

As shown in FIGS. 2*a*, 2*b* and FIG. 4, the illustrated embodiment of the switch-actuating mechanism 50 includes two, low inertia, horizontal strips 52 and 54. These strips 52 and 54 are mounted on hinges so that strips 52 and 54 are hinged along a portion or the entirety of the width of the panel above and below individual trigger plates 40.

Each such trigger plate 40 is held in position between the strips 52, 54 at the top of each sensor wire 12 by the appropriate tension in the sensor wire 12. These hinged strips 52 and 54 may be held in position against the trigger plates by built-in torsion springs (not shown) located at intervals along the hinge pins 56, 58. With any motion of any individual sensor wire 12, the corresponding trigger plate 40 moves against one of the strips 52 or 54 to thereby rotate the strip about its hinges into contact with snap action switches, as will be discussed herein.

As seen in FIGS. 3*a*, 3*b* and in FIG. 4, the lower rail 20 comprises two angle plates 64 and 65. To provide restraint and adjustable tensioning of the sensor wires 12, in accordance with one embodiment of the invention, a plurality of tensioning brackets 66*a-n* are provided, respectively receiving each sensor wire 12, which pass through small holes at the top of angle plate 64 and which are bent to hook into the top of the tensioning brackets 66. In accordance with one embodiment of the invention, the tensioning brackets are formed, open-ended boxes having respective rivet nuts 68 disposed at the bottom of each bracket 66, which receive respective tension adjustment screws 70 that pass through holes in the angle plate 65. The head of each screw 70 thus is on the outside and available for adjusting the tension on the corresponding sensor wire. It will be appreciated that the side of the bracket 66 resting against the angle plate 64 allows up and down motion of the tensioning bracket while at the same time resisting turning torque as the screw is adjusted.

As best shown in FIG. 4, the arrangement of the two angle plates 64, 65 that comprise the lower rail 16 allow for a particular ease of construction. The sensor wires 12 are fed through the holes in the upper portion of the angle plate, which can then be slid upward along the wires to enable easy access to the tensioning brackets 66 held in position by the screws through the lower portion. The upper portion may then be slid into place, where it may be welded, riveted, or joined by any other desired means. Once the assembly is complete the posts are installed between the rails.

Figure 5:
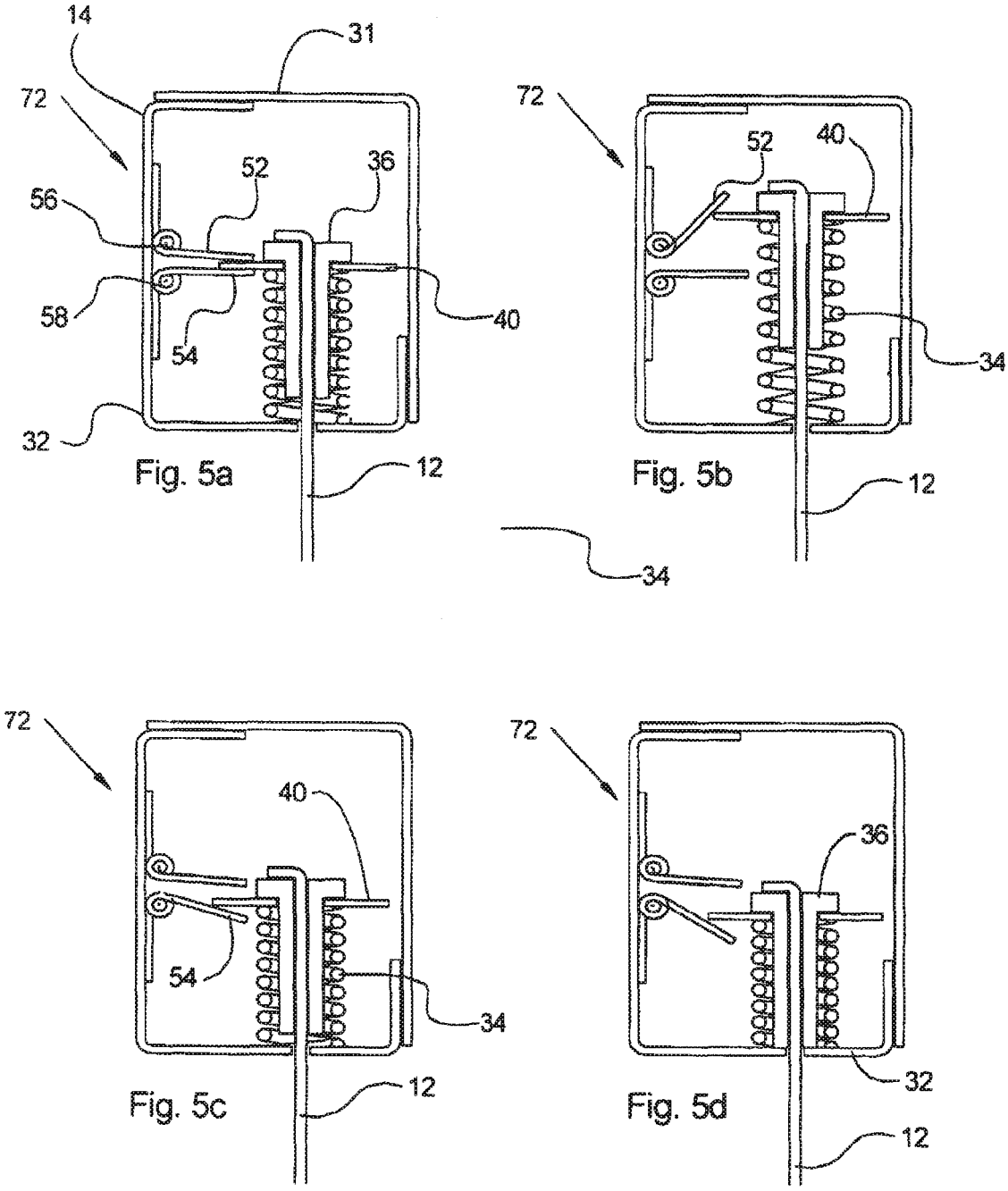
FIGS. 5*a*, 5*b*, 5*c* and 5*d* show various positions of a switch trigger mechanism in accordance with one embodiment of the invention with respect to the various conditions illustrated in FIGS. 6*a*, 6*b*, and 6*c*.

The operation of the panel is described in FIGS. 5*a-d* in conjunction with FIGS. 6*a-c*. In FIG. 5*a*, the elements of the trigger mechanism 72 correspond to those shown in the described FIGS. 2 and 4. The representative trigger mechanism 72 is in correspondence with a representative panel 11 shown in FIG. 6*a*, both indicating a non-alarm condition. The trigger plate 40 rests between the strips 52 and 54 because of the compressed state of spring 34, the compression of which is adjusted (e.g., using screw 70, see FIG. 4) to maintain trigger plate 34 at this normal position.

If as is shown in FIG. 6*b*, a sensor wire 12 is cut, the result is shown in FIG. 5*b*. Spring 34 is released and may move to an extended position because there is no tension on the sensor wire 12. Upper hinge strip 52 is displaced upwardly by the trigger plate 40 to close the snap switch connected to the hinge strip (not shown) that will indicate a cut alarm condition.

As seen in FIG. 5*c*, a downward pull on the wire 12, caused for instance by the attempt to force apart the wires 12 as indicated in FIG. 6*c*, will cause further compression of the spring 34 and thereby cause the lower strip 54 to be rotated downwardly to close the snap switch (not shown) that will indicate a pull alarm condition. The downward force will occur from the spreading apart of two adjacent taut wires 12 or moving a single taut wire to one side (such motions are those generated by an attempt to pass through the fence). As shown In FIG. 5*d*, spring 34 is in its maximum compressed state and sensor wire retainer 36 is pulled hard against the base 32 of the rail. It will be extremely difficult for the wire to be spread beyond the point where his condition occurs because of the increased resistance. It will be appreciated that this increases the physical barrier effect of the panel 11.

It will be appreciated that an attempt to climb even the smooth vertical taut wires, as opposed to the razor wire, is a very difficult proposition due to the difficulty of gripping the thin wires. However, it will be noted that such attempts will apply downward forces on the vertical sensor wires. These forces will compress the tensioning springs and generate alarms in the same manner as the forces applied to the taut wires by moving them horizontally (i.e. spreading motion).

Figure 6D:
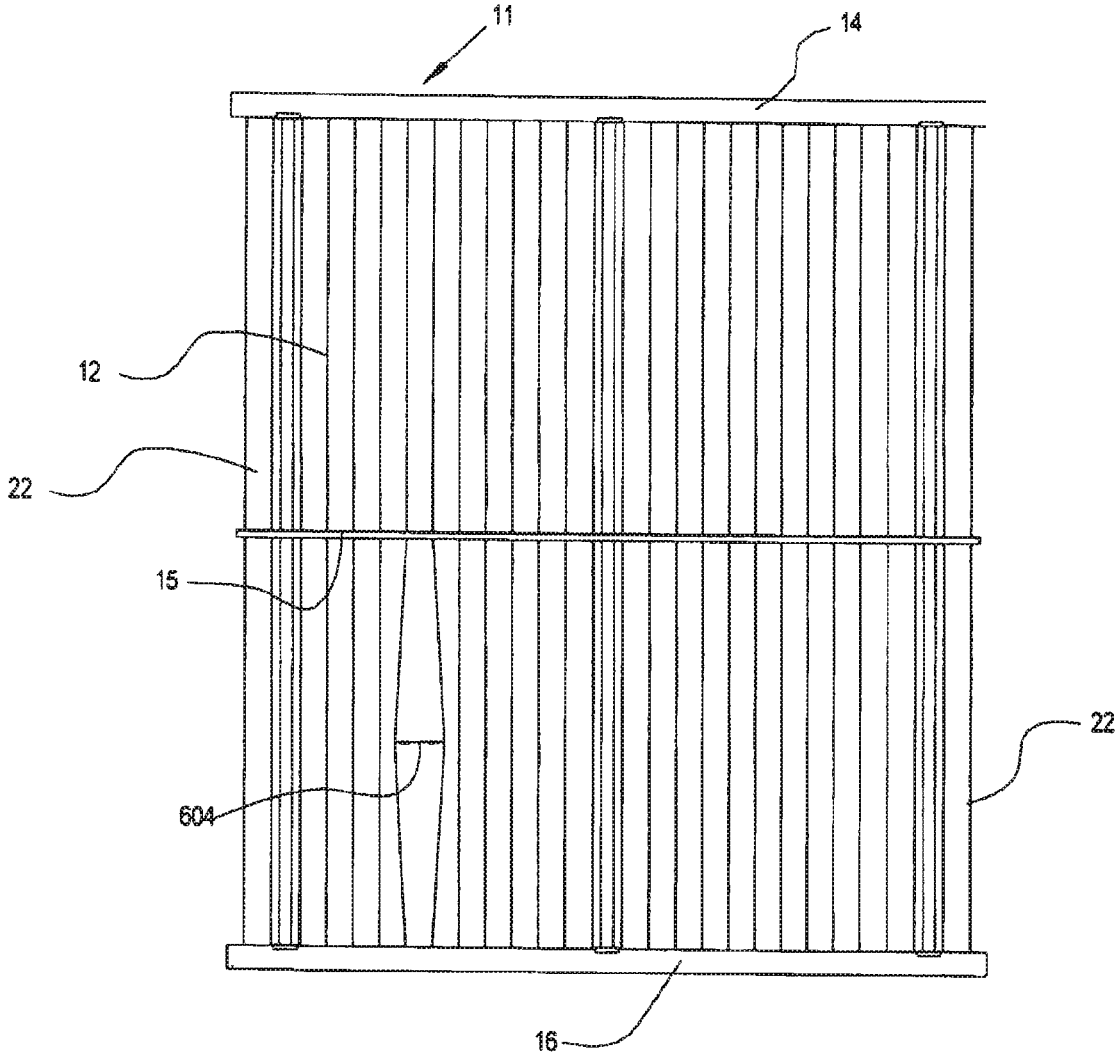
FIG. 6*d* shows an embodiment of a panel having a sensor-wire wire restraint located part way between the upper and lower rails to increase pull alarm sensitivity in accordance with one embodiment of the invention.

FIG. 6D shows an embodiment of a panel 11 having a wire restraint to increase pull alarm sensitivity. Bar 15, which may be of steel nominally one-eighth-inch thick, is bolted to the support columns 22 of a panel at the midpoint of the panel. The sensor wires 12 pass through apertures in the bar 15. It will be appreciated from inspection of the figure that because of the decreased distance of wire run between one of the rails 14, 16 and the bar 15, the required spreading gap shown at 17 necessary to generate a change in state of the trigger mechanism.

The top of each panel may be surmounted by razor wire or the like if a more formidable appearance plus entanglement to slow barrier penetration is desirable. Razor wire or the like may also be arranged to protrude through the vertical sensor wires if desired. Returning to FIG. 1*a* and FIG. 1*b*, there are shown outrigger frames 90, mounted at the top of the panels 11 and 11'. As seen in FIG. 1*b*, the representative frame 90 is conveniently mounted by means of a horizontal support 92, pivoting on a collar 94 attached to post 96. Connection brackets 98 may be fastened to the sensor wires 12, for instance, by use of a clamp 100 such that any movement of the outrigger frame (90) is transmitted to the sensor wire 12 to which it is attached. It will be appreciated that attempts to place a ladder against the top of the fence or that attempts to cross over the top of the fence will trigger an alarm in similar fashion to that described above. It will be understood that the wire may be razor wire as illustrated in FIG. 1*a* or that smooth wire or barbed wire may be used as desired. The wires may also be arranged horizontally or diagonally as desired. FIGS. 7*a* and 7*b* show an alternate embodiment of the outrigger using razor wire coils. As shown, the coil 97 is supported at the top of the panel 11 by upper support arms. Upper support arms along the length of the panel 11 support a horizontal support bar 93, nominally extending the length of the panel. The support arm 95 is attached to the panel support columns by means of clamps 100. The coil 97 is connected to the bar 93 conveniently using suitable wire ties (not shown). Lower connecting arms 99, one of which is shown, carry lower horizontal support bar 101, to which coil 97 is conveniently attached by suitable wire ties (not shown). The other end of lower connecting arm 99 is attached by clamps 100 to a panel sensor wire 112. It will be understood that other means for attachment to the sensor wire may be used if desired. It will also be understood that barbed wire may be used in place of the razor wire. In this embodiment the coil itself provides an intimidating barrier to an attempt to climb over the top of the fence panels, the motions generated by the razor wire coil during any such attempt will be transmitted to the sensor wires to which the lower support arms are clamped to create an alarm as described in connection with previous embodiments. For improved sensitivity to intrusion the linear motion detection system may be mounted on the coiled barrier. Each panel control system is capable of accepting inputs from both systems at the same time.

Returning once again to FIG. 1*a*, it will be noted that the second wire from the end in each panel 11 and 11' may be pulled over toward the adjacent panel. The wires are held in this configuration suitably by means of a hog ring 102 or the like. It will be appreciated that this configuration will trigger an alarm in the event that there is an attempt simply to lift an entire panel to avoid having to deal with individual sensor wires. It will also be seen that a cut alarm will be generated as the wires go slack in the event that the hog ring 102 is cut. The movement of the one panel away from the other under this condition will trigger an alarm in either the moved panel or the adjacent panel.

It will be appreciated by those skilled in the art that the design of the present system virtually eliminates false alarms due to temperature changes by allowing the detection means at the top of the taut wires to move at the same rate and in the same direction as the upper end of the taut wires move when the sensor panel is subjected to temperature variations. That is, if the wire 12 and end posts 22 have similar coefficients of thermal expansion, temperature related expansion/contraction will result in minimal or no physical change in relative length between the wires and posts. Hence, the trigger mechanisms are not tripped. Further, use of vertical wires substantially eliminates snow build up that can result in false alarms.

As noted above, the panels are modular. This allows the panels to be set up temporarily if desired. However, it will be noted that the panels typically form permanent structures. Further, such modularity allows for quickly replacing a damaged panel if necessary, thereby reducing the time a damaged perimeter fence needs to be actively monitored (e.g., patrolled) by security personnel.

An electrical connection arrangement between panels connects embedded micro-controllers and associated sensing and communications hardware, which are used as sector and panel controllers. In this regard, there may be a panel controller associated with each panel and a sector controller is mounted within one of the end sensor panels of any group of sensor panels controlled by that sector controller.

Figure 8:
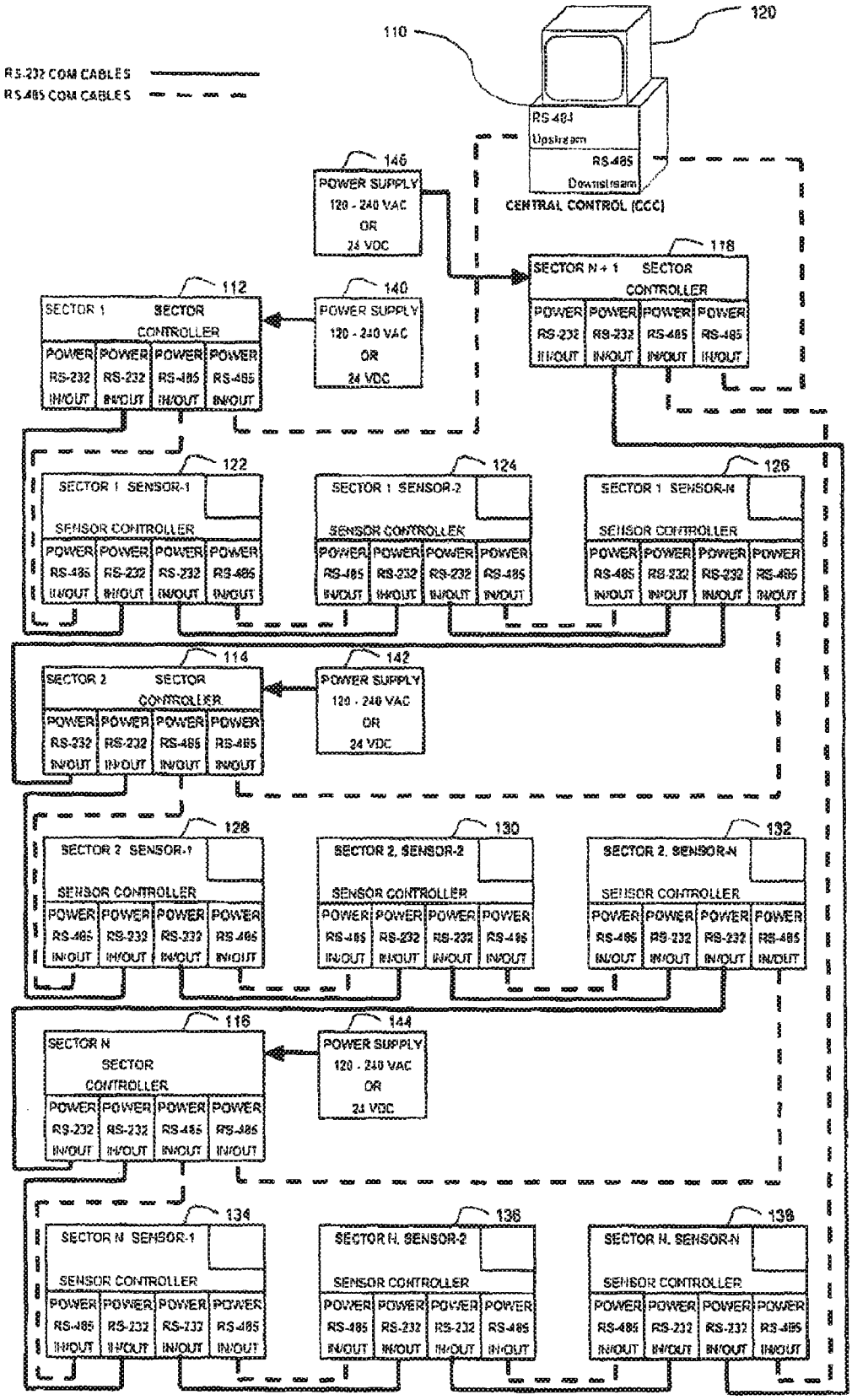
FIG. 8 is a diagram of the arrangement of the monitoring electronics of an array of sensors in accordance with one embodiment of the invention.

FIG. 8 is a schematic diagram of the arrangement of the monitoring electronics of an array of panels in accordance with one aspect of the invention. The electronic control of the system is both physically and electronically subdivided into "sector controllers". Each "sector" contains one or more of the sensor panels, each of which has a "panel controller". A grouping of sectors is called herein a "facility." Each sector controller communicates with all of the panel controllers within its sector. The panel controller monitors the position of each snap switch in the sensor panels (wire pull, wire cut, tamper) several times a second. If a switch changes state for greater than a predetermined time (software-configurable), an alarm state is generated which will preferably stay active until a communications signal is received to clear the alarm state. Wiring bundles' carry communication signals and power to the panel controller. As seen in FIG. 8, in the facility 110, all of the sector controllers 112, 114, 116, 118 are connected to each other and this facility is connected to a monitoring station 120, which is typically a PC utilizing Microsoft Windows for operation, but can be any kind of computing device capable of signaling an interested party that an alarm condition has occurred. Four sector controllers are shown, but it will be appreciated that the sectors are not limited to only four and that fewer or greater sector controllers may be utilized in a facility. For example, if sector controller 118, numbered as sector N+1 is not required, then the return from sector controller 116 is connected directly to monitoring station 120.

Each respective sector controller 112, 114, 116, 118 communicates with all of the panel controllers within its sector. As shown in FIG. 8, sector controller 112 communicates with panel controllers 122, 124, and 126. It will be understood that while FIG. 8 illustrates only 3 panel controllers connected to the sector controller, each sector may be configured to have a larger or smaller number of panel controllers as desired. In similar fashion, sector controller 114 communicates with panel controllers 128, 130, and 132 and sector controller 116 communicates with panel controllers 134, 136, and 138. Each sector controller is powered by an external site-specific source, shown here as power supplies 140, 142, 144, and 146. The panel controllers may in turn be supplied with power by the sector controllers via dedicated conductors in the communication. This arrangement allows any sector controller to communicate and monitor the communications for its 'primary' sector as well as its previous (backup) sector, such that if a primary sector controller fails, the backup sector controller (next sector controller in line) will be able to monitor the failed sector until hardware can be replaced. Communication between panel controllers and sector controllers is preferably two-way, so that any message generated anywhere within a sector will be sent to all of the panels in the sector and to all sectors and panels in the facility. Thus, if a panel controller fails, the 'repeated' two-way nature of all sector to panel and panel to panel communications in the system, allows the next sector controller in line to monitor, in an 'upstream' direction, the panels that can no longer be controlled by a primary sector controller "downstream" of the failed panel.

A sector controller communicates with, and monitors the health and state of, and provides power for one or more panel controllers. Communication between sector and panel controllers is provided via an RS-232 communications buss and in one embodiment, the communications protocol may be a packetized, addressable messaging scheme that provides for detection of message framing errors and transmission errors through checksum. A synchronous, round robin, polling, message addressing system may be used, so that no panel controller will initiate a packet. That is, a panel controller will not necessarily place a communications packet on the communications buss without having first been polled by a sector controller to determine its state.

It will be appreciated that each panel controller RS-232 communications transceiver acts as a repeater for all panel-to-sector and sector-to-panel communications, regenerating all signals and thereby allowing for greater communication distances and a decrease in overall system cost, by increasing the number of panels which can be monitored by a sector and spreading the cost of the sector controller over more panels.

Sector controllers communicate with each other and to the central monitoring station. In the present embodiment, these communications are carried out over an RS-485 communications buss, and can be configured in either a multi-drop wiring topology (not shown) or, through the use of two RS-485 transceivers on each sector controller as shown here, one or more sector controllers in a system act as an RS-485 repeater, regenerating all signals such that longer communications distances can be realized. Sector controllers are polled by the central monitoring station for their status in a method similar to the panel controllers.

The polling messaging method described herein provides a convenient way to determine failure of any single point in the system. If a panel or sector does not respond to a configurable number of polling requests (because, for example, of some power or hardware error in the sector or panel in question), the error will be interpreted by the central monitoring station as an intrusion (an attempt to get through the system by interrupting power or destroying the sensor panel) and an alarm will sound.

Communications redundancy and robustness is increased by the ability for all sector controllers to act as a backup sector controller to another sector. If a cable is cut, or a panel controller becomes non-functioning, a primary sector controller will lose the ability to communicate with all panels beyond it. In the case where the first panel of a system is inoperable, this will render the entire sector incapable of being monitored. In the event of such a failure, the central monitoring station can command the backup sector controller for the malfunctioning sector to begin polling the sector from the end of the sector back to the beginning.

Figure 9:
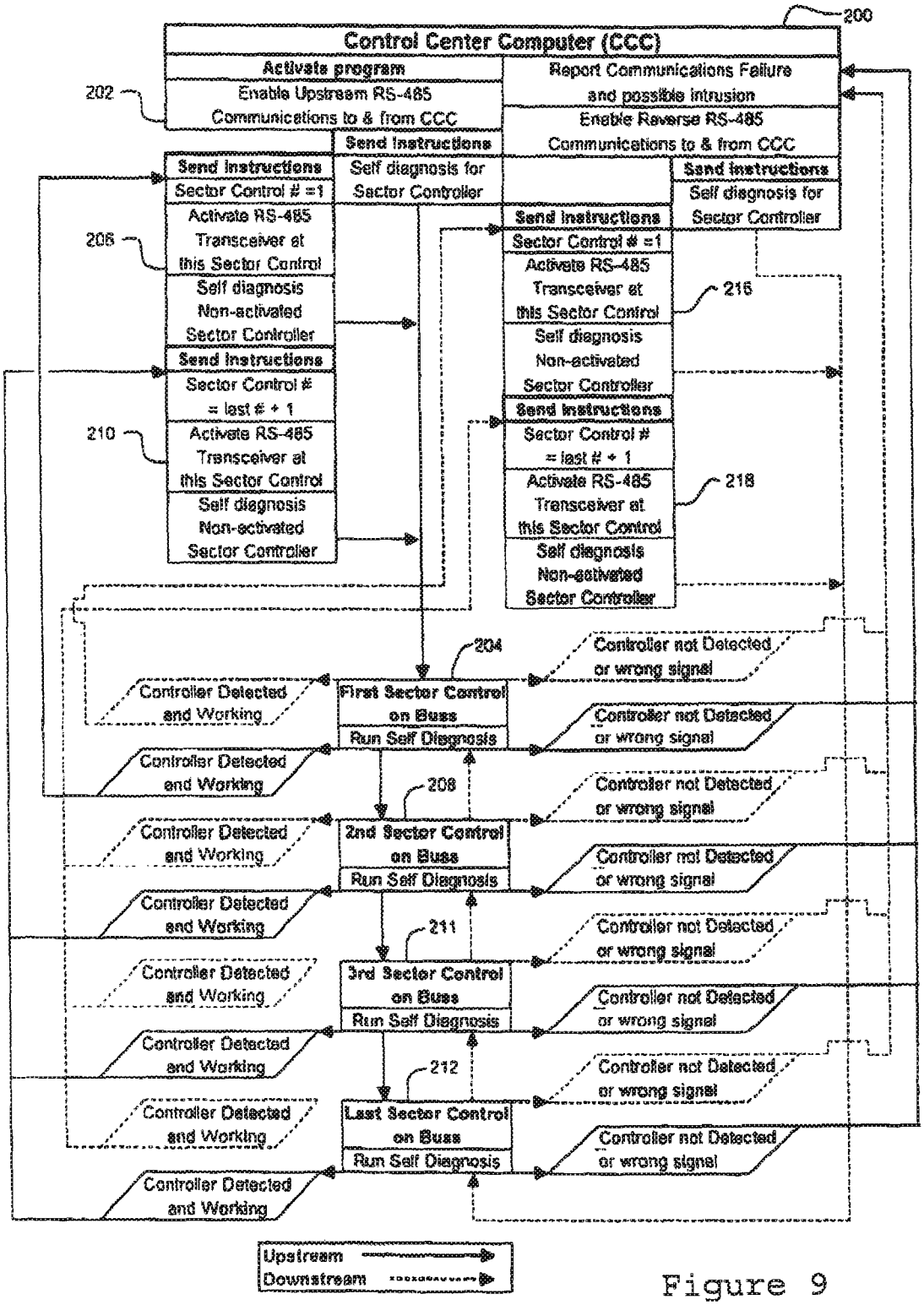
FIG. 9 is a flow diagram of a sector control start-up and auto-numbering sequence in accordance with one embodiment of the invention.

In FIG. 9 a flow diagram 200 of the sector panel start-up and an auto-numbering sequence. The program at the central control computer is activated to enable upstream RS-485 communications. All sector controllers in active mode are connected in a "Ring Topology" thereby enabling 2-way communications once they are activated. However, the sector controllers can provide limitations, for example, not allowing any communications past their location until their RS-485 Transceivers are activated. When activated, the RS-485 Transceivers at each Sector Controller can receive both Upstream and Downstream signals and will amplify and transmit all received signals in both directions. The control computer sends instructions to the first sector controller at 204, which thereupon runs a self check and reports it status to the computer. If the controller is detected and working, at block 206 its control number is set to 1, its RS-485 transceiver is activated to allow instructions to be sent to 2nd sector control, which runs its self-diagnosis at block 208, which then enables successive instructions to additional sectors on the buss, blocks 210 and 212. The program will continue issuing numbering instructions and activating transceivers until the control computer receives a sector control transceiver activation command. This command informs the Control Computer that the Ring Topology is complete and configured and that there are no more sector controllers requiring activation.

In the event that a controller has not been detected or that it has sent a wrong signal, the failure is reported at block 214 and a reverse communication path is enabled. The instructions are sent to the last sector controller to begin a reverse renumbering sequence, blocks 216 and 218. If everything in the sector control startup and numbering procedure is in order, the program then proceeds to Panel Controller Startup and Auto Numbering procedures described in FIG. 10.

Figure 10:
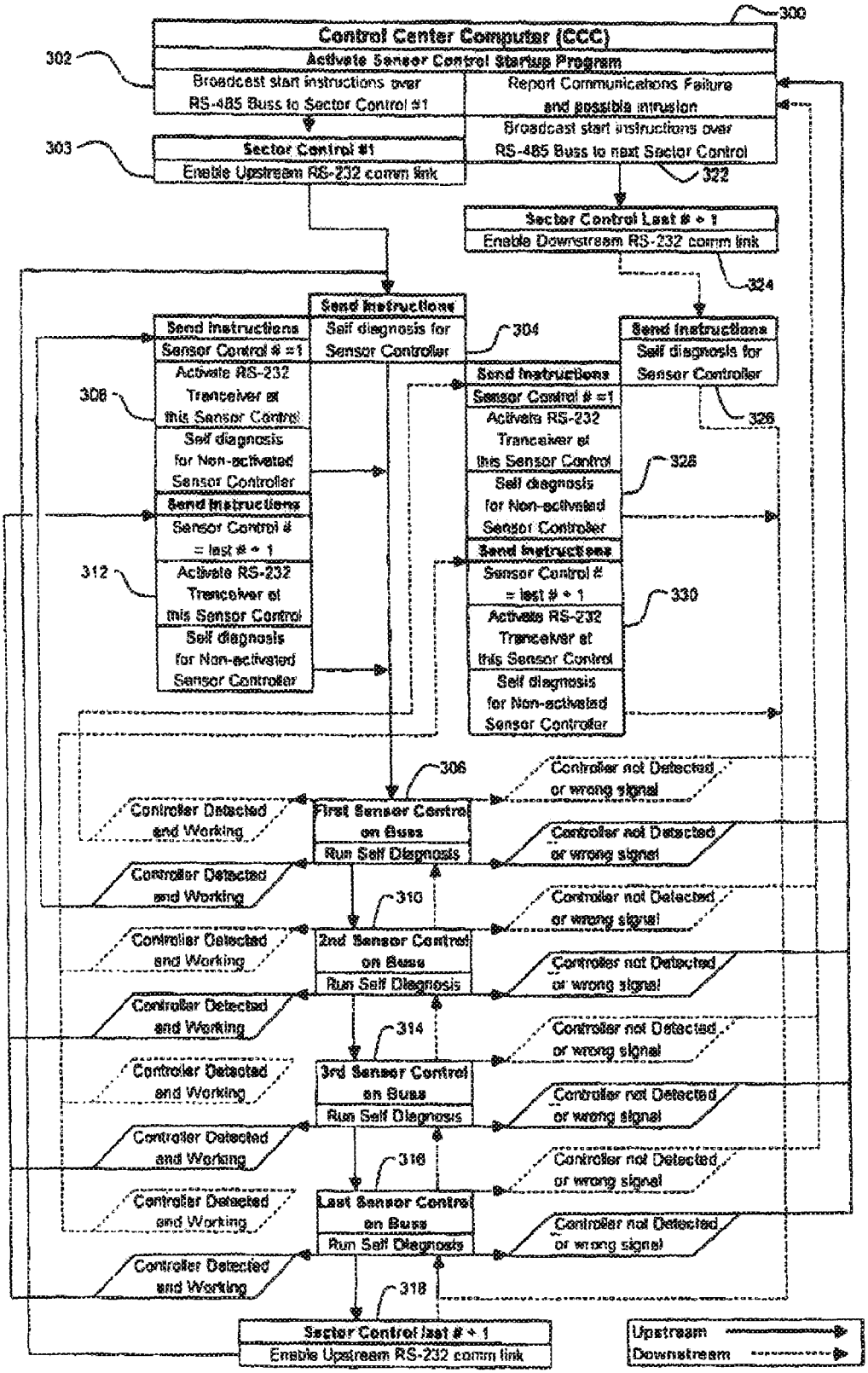
FIG. 10 is a flow diagram of a sensor control start-up and auto-numbering sequence in accordance with one embodiment of the invention.

In FIG. 10 a flow diagram 300 of the panel control start-up and auto-numbering sequence is shown. As is the case with sector controllers, panel controllers do not allow any communications past their location until their RS-232 transceivers are activated. When activated the RS-232 transmitters at each Panel Controller may receive both Upstream and Downstream signals and may amplify and transmit all received signals in both directions. At the beginning of the panel control startup, the control center computer sends instructions to sector controller number 1, block 302, to enable its RS-232 communications link, block 303. At block 304, the panel controller is ordered to perform its self-diagnosis at block 306. If the controller is detected and working, at block 308, the panel controller number is set to #1 and instructions are sent to the second panel on the buss, which performs its self-check at block 310. If this controller is working, at block 312, the panel controller number is set equal to the last number+1, and instructions are sent to the next panel controller to perform its self check at 314 and so on to the last panel controller check at 316, which then enables the complete upstream link at block 318. If in response to any of the self check commands, the controller is not detected or a wrong signal is sent, a communication failure or intrusion report is generated and instructions are sent to the next sector controller, block 322, to enable the reverse RS-232 communication link for the last sector+1, block 324, and instructions are sent for panel control self-diagnosis, block 326. Panel numbering then proceeds in the opposite direction, blocks 328 and 330.

When Auto Numbering the Sector Controllers the program will continue issuing numbering instructions and activating transceivers until the next sector control in line receives a panel control transceiver activation command. This command informs the Sector Control that the buss configuration is complete for it's Sector and that there are no more Panel Controllers requiring activation. The control computer may be considered as sector control #0 for program and software considerations. When the final sector controller is reached it will detect the control center computer (Sector #0) and will activate the polling and alarm generation loops.

Figure 11:
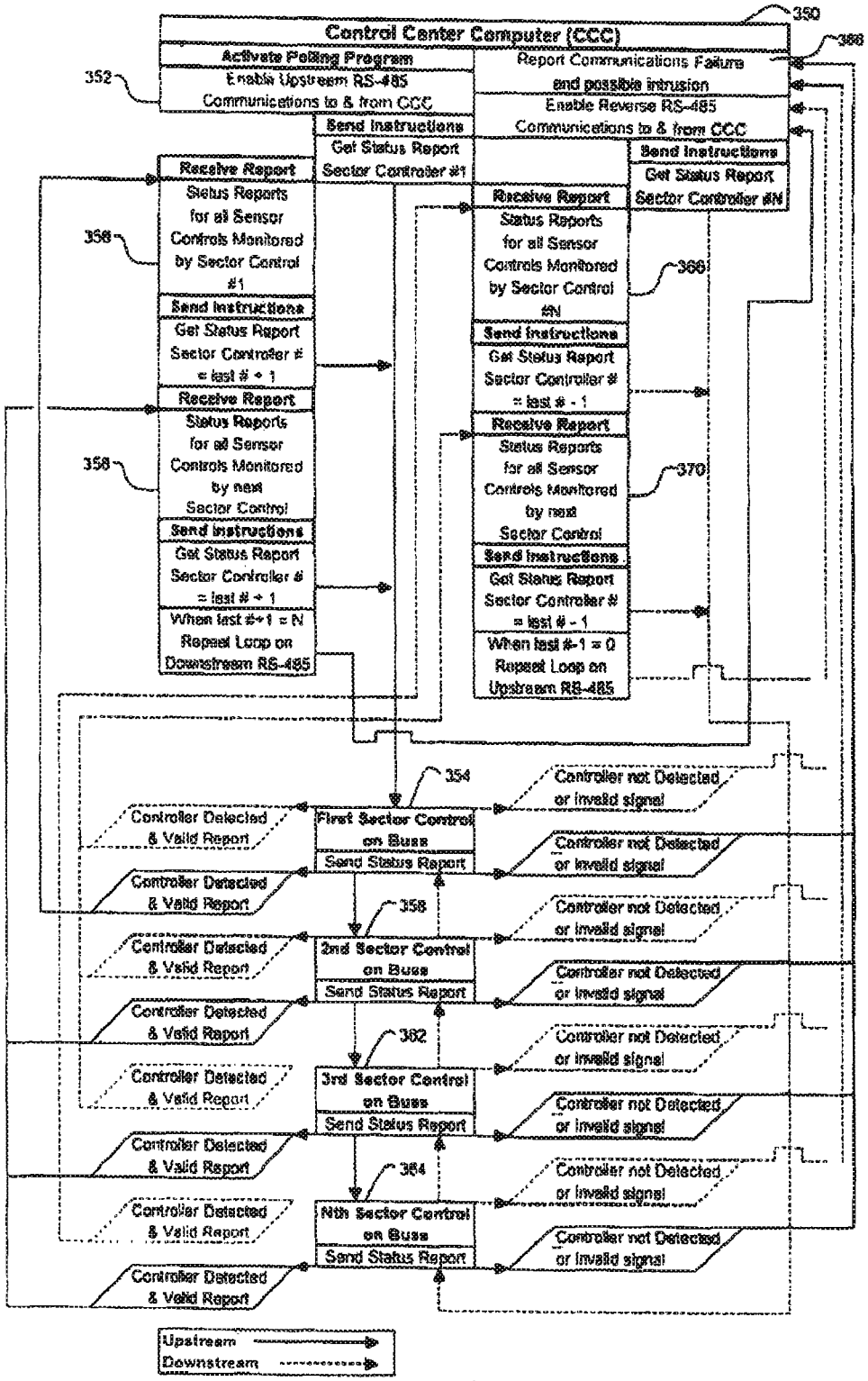
FIG. 11 is a flow chart of the polling of sector controls for alarm reports.

FIG. 11 is a flow diagram of the polling of controllers for alarm generation.

As mentioned previously, all sector controllers in the present embodiment are connected using ring topology while the panel controllers are connected using a buss topology in which all signals are retransmitted (repeated) at each node of the network so as to enable two-way communication. Also it must be remembered that the controllers do not necessarily allow any communications past their location unless their transmitters are activated. When activated the transmitters at each controller will receive both Upstream and Downstream signals and will amplify and retransmit all received signals in both directions. When auto numbering is completed the program fall to block 350 to poll the sector controls for alarm reports. At block 352, upstream RS-485 communication to the control computer is enabled and instructions are sent to get data from the first sector control on the buss, block 354. The information from the first sector control is received back and, if valid, the status reports of all panels in the sector are received and an instruction to get the next sector report is sent, block 356, which is transmitted to the second sector controller to send its status report, block 358. Valid status reports are received and new instructions are sent, block 360, to the succeeding controllers, block 362 and 364, until the end is reached. In the event of error or of an indication of possible intrusion, there is a report sent to the central control computer, as well as after polling the last sector controller in the ring, the reverse RS-485 communication is enabled, block 366, and instructions sent to the last sector controller on the buss to again send its report. The sector, block 364 again is commanded to send its status report, block 358, and the next sector controller in the ring is asked to send its report. The program notes receiving of the valid report, and proceeds to instruct the next controller to send its status report, block 370. The program continues to ask for and receive reports in the downstream direction until the first controller is reached at which point, communication in the opposite direction is enabled. Thus when polling for alarm conditions, the polling program will alternate between upstream and downstream communication until an alarm condition or missing controller is reported at which time the communication direction will be reversed.

As an example only, in a ten-sector system, assume that sector five has become inoperable. In this case the central computer can poll downstream sectors one through four, but fails at sector five. An alarm state now exists and is signaled to the operator. The central control computer will now begin polling from the upstream direction until sector five is reached. In this manner, communication is assured with as much of the system as possible at all times.

Figure 12A:
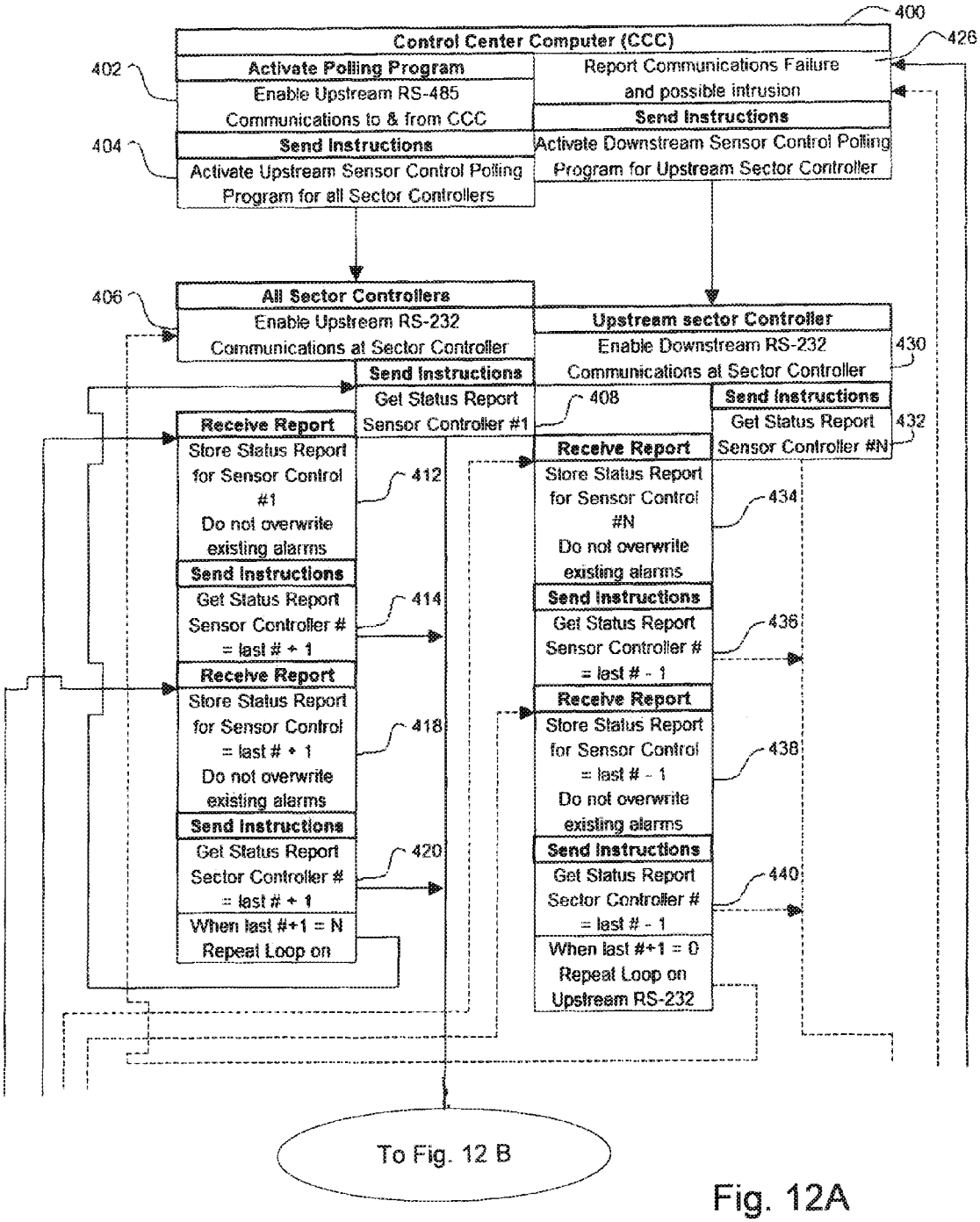
FIGS. 12A and 12B illustrate is a flow diagram of a polling of sensor controllers for alarm generation in accordance with one embodiment of the invention.
Figure 12B:
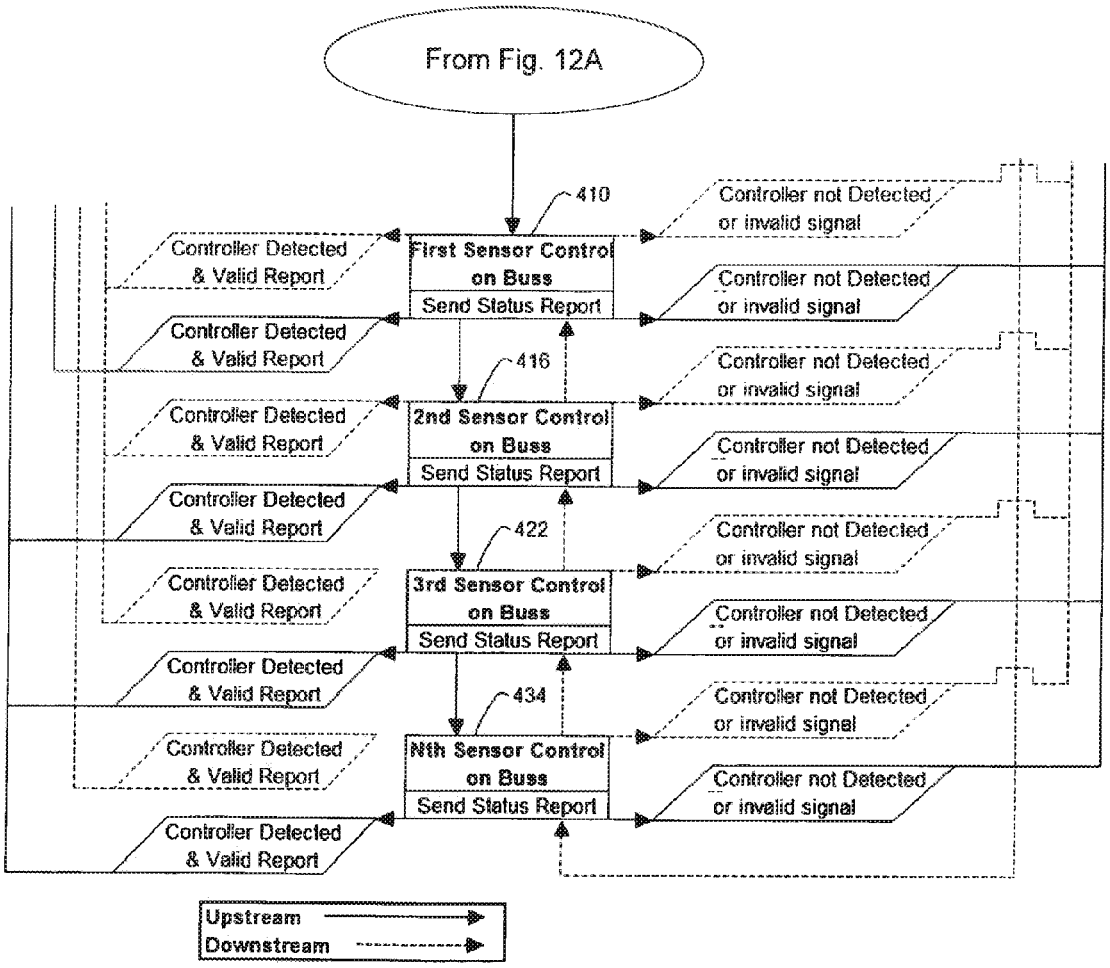

In FIG. 12, the sector control polling of the panels is illustrated. The polling program 400 is activated at block 402 to enable communication and the instructions to activate upstream panel control are sent at block 404. Upstream RS-232 communication is enabled, block 406, and instructions are sent to panel controller #1 for a status report, block 408. At 410, the first panel controller on the buss is commanded to send its status report, which is received and stored. Instructions are then sent to the next panel controller in line, block 414. Status is read at block 416 and received and stored, block 418, instructions are sent to the next controller, block 420, which in turn sends its status report, block 422. At the last panel controller, indicated here at 424, the loop is repeated in the opposite direction.

In the event that there is an error or communication failure, the condition is communicated to the control computer, block 426, and the downstream polling program is entered, block 428. The RS-232 communication is enabled, and the program drops through the iterated sequence shown in blocks 434, 436, 438, and 440 to command each succeeding panel controller to send a status report and to store the status reports in the central computer as describe in connection with blocks 412 through 420. When the last panel controller is reached, the loop is repeated in the opposite direction.

Figure 13:
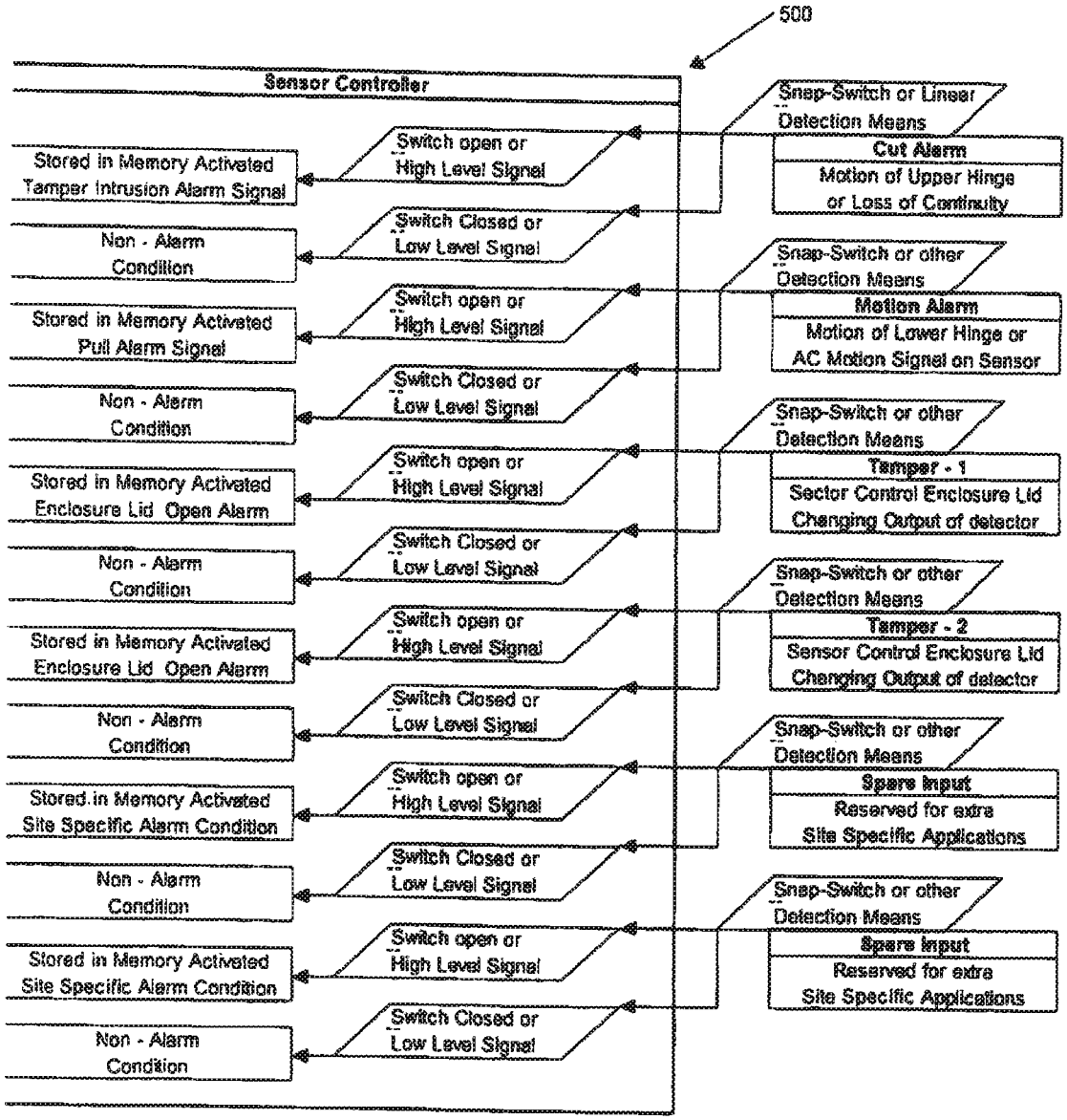
FIG. 13 is a flow chart illustrating an alarm generation at the sensors in accordance with one embodiment of the invention.

FIG. 13 illustrates a flow chart of a program 500 of the alarm generation at the panels. Under control of the embedded microprocessor, the panel controllers monitor the position of each alarm switch in the sensor panels, preferably several times a second. The snap action switches are typically in a closed (grounded) in the non-alarm state. If a switch changes state for greater than a predetermined time (software-configurable), the microprocessor can detect the change and an alarm state is generated which may stay active until a communications signal is received to clear the said alarm state. In this figure there are also shown optional inputs for tamper switches and a fourth input not used which is available for detecting the state of other switches or input as desired.

It will be understood from the foregoing that since each sensor panel section of this fence system, attached to and located between perimeter fence line posts, has its own separate detection means, the accuracy of detection is determined by the spacing of fence line posts that are typically 8 or 10 feet apart in accordance with one embodiment of the invention, the present system can therefore position an intrusion signal to within an 8 to 10-foot section of a perimeter fence.

Further in accordance with one exemplary embodiment of the invention, the sector control units can be located at greatly extended intervals along a perimeter fence line. The location of these units is only limited by the ability to transmit power to the panel controllers, this power being provided from the digital multiplexing sector control units.

The present system panels may suitably be generally manufactured from galvanized or powder coated mild steel plate and tube with stainless steel sensor wires. It will be understood that if required for deployment in highly corrosive locations such as marine shorelines the present design allows the mild steel components to be replaced with stainless steel components without a prohibitive cost penalty. In extreme corrosive locations such as those with high chlorine content the sensor wires can be glass fibers and modular panels may be constructed from resin reinforced with glass fibers or if conditions warrant a lightweight construction the entire structure may be fabricated from aluminum.

In one embodiment the system may use simple "on-off" signal technology that can be achieved using standard snap action switches. This solution for alarm generation allows easy sensitivity control by the mechanical adjustment of snap action switch positions during manufacture and less complex software control due to there being no requirement for A/D conversions or environmental compensation controls.

Another aspect of the invention relates to identifying intrusion of a secured perimeter using a vibration sensitive detection system that utilizes microphones and/or microphonic cables and/or other suitable flexible linear detection means of converting physical motion and vibration into frequencies embedded in an AC electrical signal. More particularly, one aspect of the invention is directed to the processing of such signals to identify intrusion related events. The system may include the use of flexible linear detection means attached to signal-processing circuitry for use in situations requiring both flexibility and adaptability to suit a specific perimeter configuration, and also to provide an automatic means for rejecting a multiplicity of signals that would otherwise trigger a false alarm, which are caused by a general increase in the prevailing level of noise or vibration in the vicinity of the sensor or sensors used.

This aspect of the invention may be utilized in conjunction with the modular fencing system discussed above or utilized to provide intrusion detection on other fencing systems. Generally, the system utilizes the triboelectric or noisy cable effect of coaxial cables to provide an input to the system. In this regard, a flexible linear sensor (e.g., coaxial cable) may be secured to a fence and a signal form the linear sensor may be monitored. Such a linear sensor is operative to convert physical motion that the cable experiences into frequencies. That is, such a linear sensor is responsive to noise generated by motion on a fence (e.g., chain link fabric, perimeter fence) to which the sensor cable is attached.

The vibration detection system of present invention has been designed to detect and measure the amplitude and duration of a combination of the primary frequencies applied to the fence fabric by human intrusion. In one embodiment of the invention these frequencies may be generally inaudible ranging from 1 Hz to 30 Hz and 15000 Hz to 22000 Hz. However, some audible frequency bands within 100 Hz to 8000 Hz may used in the present embodiment for comparison within logic determination of primary frequency sources.

For example when human intruders disturb fence fabrics several primary frequencies of sound may be generated in response to specific motions of attack. Motions such as climbing typically generate primary large amplitude long duration 1 Hz to 30 Hz low frequency primary signals while cutting of fence fabric will produce primary lower amplitude shorter duration 1 Hz to 30 Hz low frequency primary signals plus short duration varying amplitudes of 15000 Hz to 22000 Hz high frequency secondary signals. Both types of primary frequency disturbances will generate various amplitudes and durations of secondary audible frequencies in the 100 Hz to 8000 Hz range.

These primary frequencies will be introduced into the fence fabric in addition to any audible frequency signal that may already be being generated by environmental effects such as rain or hail. These audible frequency vibrations generated by environmental effects do not contain the higher and lower frequency inaudible sounds found in the aforementioned primary frequencies generated by human intrusion. Logical comparisons of these various levels and duration of primary frequency inputs and audible environmentally generated vibrations in comparison with preprogrammed criteria may produce a far more reliable determination of human intrusion attempts than previous determinations using only secondary frequency comparisons of vibrations that may be generated by any source.

The system includes signal-processing circuitry for use in an linear sensor intrusion detection system that provides both flexibility and adaptability to many different intrusion detection situations, and also provides an automatic means for rejecting a multiplicity of signals that would otherwise trigger a false alarm, which are caused by a general increase in the prevailing level of noise or vibration in the vicinity of the sensor or sensors used.

Figure 14:
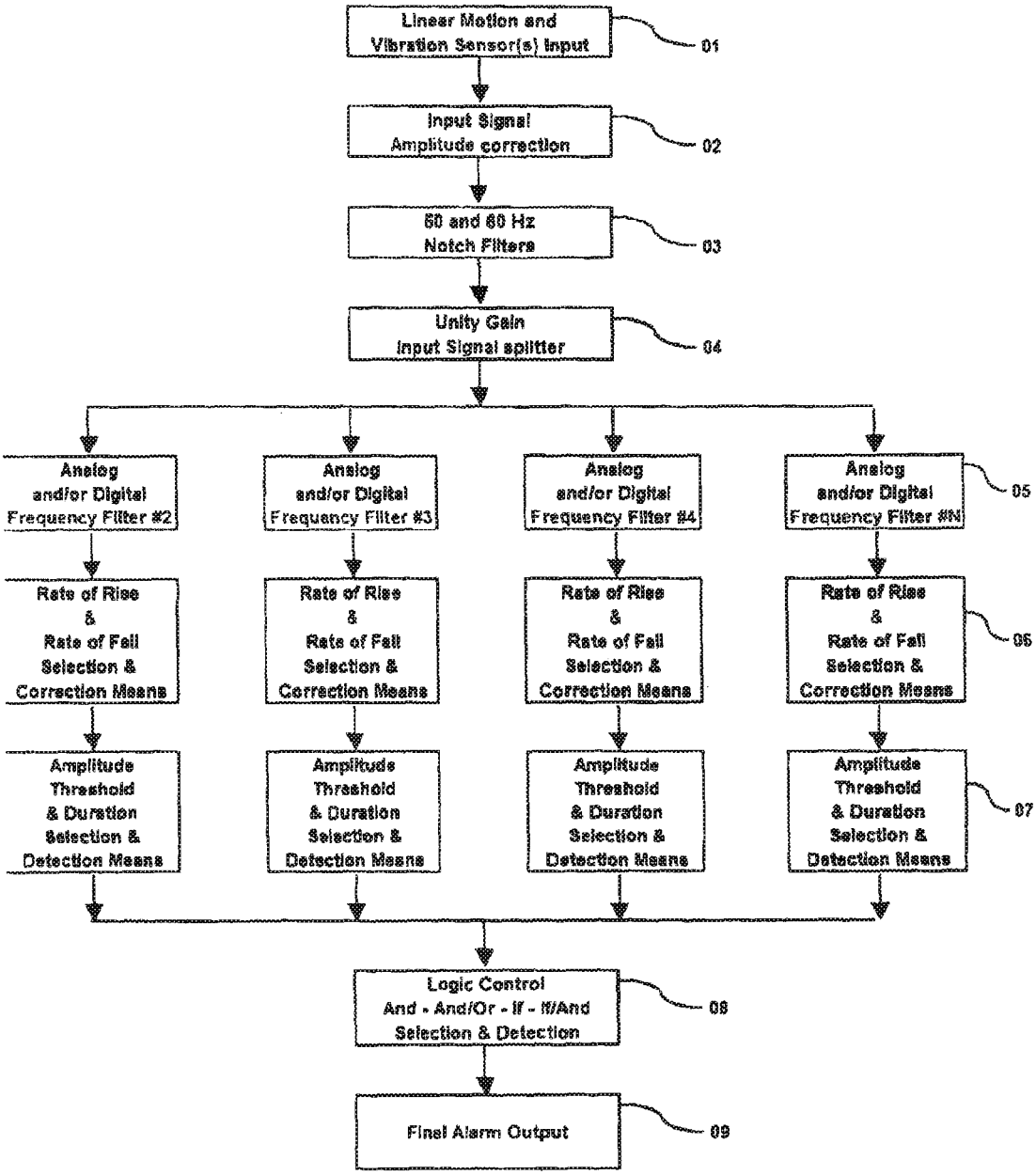
FIG. 14 shows an electrical connection arrangement between sensors in accordance with one embodiment of the invention.

In one embodiment, a number of signal analyzers are provided each including a bandpass filter tuned to a selected frequency range. Each filter receives the output of a least one of the sensors used for the system. The output can be received direct from the sensor or via intervening signal processing circuitry. For example, if the output signal from the filter has to travel long distance before reaching the remaining signal-processing circuitry, it may be desirable to incorporate an amplifier for the signal in the vicinity of the filter so that the strength of the amplified signal at the input of the rest of the signal-processing circuitry is adequately high. Referring to FIG. 14, a sensor 1401 is placed within or near a secured space or attached to a movable or flexible barrier surrounding the secured space and used to collect the vibrations and motions generated by intrusive movement. In the present embodiment, the sensor 1401 may be a motion sensitive coaxial cable, microphone detector, pressure-sensitive detector, or other suitable sensing device adapted to the particular installation.

The sensor output passes into the first stage of signal conditioning 1402 where it is subjected to adjustable amplification or attenuation depending upon signal strength followed by passing through a line-frequency notch reject filter 03 so as to reject spurious signal components at the line frequency (typically 60 Hz in North America 50 Hz in Europe).

Throughout this description it is understood that any conventional signal processing devices may be inserted in the circuitry where desired to modulate the signal in some suitable way. Equally, in some cases those of ordinary skill in the art will recognize that the sequence of various elements could be reversed. Notch filters could, for example, follow the bandpass filters. But it is generally easier and less expensive to have a single notch filter precede all of the bandpass filters.

The output of the notch filter is applied to a buffer stage 1404 that splits the signal through the use of unity gain analog or digital means into a plurality of equal signals each on different input lines into separate analog or digital bandpass filters. The number of bandpass filters 1405 to be chosen will be dependent upon the application. In FIG. 14, four bandpass filters (#1, #2, #3, and #4) are shown for reasons of clarity, although in other applications more or less bandpass filters can be used. Each filter is independently tunable to a particular passband frequency selected by the designer to suit the particular perimeter application.

The next stage 1406 of each circuit slows the rate of rise of the signal amplitude to an adjustable level if the signal amplitude is maintained above a lower threshold level for a length of time determined by an adjustable time delay. This stage of signal conditioning has the effect of rejecting very short, transient signals, even if they exceed a particular preset threshold amplitude, so that such signals, which typically are spurious signals, do not cause unwanted intrusion alarms.

The next stage 1407 of each circuit slows the rate of fall of the signal amplitude to an adjustable level a length of time determined by an adjustable time delay. This stage of signal conditioning has the effect of ensuring very short, transient signals, intended to confuse the control system by an intruder, will in fact generate an intrusion alarm.

In the particular example being discussed, it may be assumed that bandpass filters #1 and #2 are tuned to two separate frequency ranges in which signal components representative of unwanted human intrusion are likely to occur. Bandpass filter #3 by contrast is a general ambient noise channel while bandpass filter #4 is tuned to that frequency range in which ambient noise, especially occasionally occurring ambient noise of fairly strong amplitude, is expected to occur (for example a passing heavy vehicle).

Although only a single sensor is shown providing a split input to each of the four bandpass filters it is to be understood that a number of different sensors could be employed, each of which could provide an output to one or more bandpass filters. Sensors may be associated with bandpass filters on a one-to-one basis, or otherwise as the designer may choose.

The outputs of the four bandpass filters are applied as inputs to amplitude threshold and duration signal analyzers 1407. At this point the signals are checked within each signal analyzer to see if the signal amplitude remains above an adjustable predetermined threshold for an adjustable predetermined length of time. If the signal does remain above the threshold for the allocated time an initial affirmative output signal is generated and sent to the Logic Control 1405.

If the signal does not remain above the threshold for the allocated time an initial affirmative output signal is not sent and the signal analyzer timer is reset to wait for the next signal. The initial affirmative output signals sent to the Logic Control 1408 are analyzed to determine if they combine to replicate a preprogrammed pattern of alarms and non-alarms. If the correct pattern is achieved a final affirmative alarm output signal is generated 1405.

While various embodiments of the invention have been described as methods or apparatus for implementing the invention, it should be understood that the invention can be implemented through code coupled to a computer, e.g., code resident on a computer or accessible by the computer. For example, software and databases could be utilized to implement many of the methods discussed above.

Thus, in addition to embodiments where the invention is accomplished by hardware, it is also noted that these embodiments can be accomplished through the use of an article of manufacture comprised of a computer usable medium having a computer readable program code embodied therein, which causes the enablement of the functions disclosed in this description. Therefore, it is desired that embodiments of the invention also be considered protected by this patent in their program code means as well.

Furthermore, the embodiments of the invention may be embodied as code stored in a computer-readable memory of virtually any kind including, without limitation, RAM, ROM, magnetic media, optical media, or magneto-optical media.

Even more generally, the embodiments of the invention could be implemented in software, or in hardware, or any combination thereof including, but not limited to, software running on a general purpose processor, microcode, PLAs, or ASICs. It is also envisioned that embodiments of the invention could be accomplished as computer signals embodied in a carrier wave, as well as signals (e.g., electrical and optical) propagated through a transmission medium. Thus, the various information discussed above could be formatted in a structure, such as a data structure, and transmitted as an electrical signal through a transmission medium or stored on a computer readable medium.

It is thought that the apparatuses and methods of the embodiments of the present invention and its attendant advantages will be understood from this specification. While the above is a complete description of specific embodiments of the invention, the above description should not be taken as limiting the scope of the invention as defined by the claims.

The invention claimed is:

1. A sensor panel for use in a perimeter protection system, comprising:

first and a second horizontal rails disposed in a fixed spaced relationship;

a plurality of spaced vertical sensor wires tensioned between said first and second horizontal rails;

a plurality of triggers, each individual trigger being associated with an individual one of said vertical sensor wires and operable to move from a static position to one of first and second opposing tripped positions upon movement of the wire, wherein the trigger is operable to move to the first tripped position upon the wire being cut and to the second tripped position upon the wire being pulled;

a switch cooperating with the triggers, wherein movement of at least one trigger causes the switch to change the state of an electrical circuit, wherein the change in the state of the electrical circuit indicates movement of one of the wires associated with a potential intrusion, wherein at least two of said individual triggers are disposed proximate to a common actuator, wherein movement of one of said individual triggers moves said actuator and wherein said actuator is connected to said switch.

2. The device of claim 1, wherein the actuator comprises:

a hinged strip located proximate to said triggers, wherein movement of any one of the triggers moves the hinged strip.

3. The device of claim 1, wherein each sensor wire further comprises:

a spring, wherein said spring maintains tension in said sensor wire and allows the sensor wire to move upon a change in tension in the sensor wire.

4. The device of claim 1, wherein each trigger is connected proximate to an end of each sensor wire.

5. The device of claim 3, wherein the triggers are housed within one of the horizontal rails.

6. The device of claim 1, further comprising:

vertical supports, wherein the vertical supports extend between the horizontal rails and maintain the rails in the fixed spaced relationship, wherein the vertical supports and the sensor wires are made of materials having substantially similar coefficients of thermal expansion.

7. The device of claim 1, further comprising:

a monitoring device connected to the switch, wherein the monitoring device monitors the state of the electrical circuit and generates an output upon a change in the electrical circuit.

8. A security fencing system formed of modular panels, said modular panels each comprising:

a frame having:

first and a second horizontal rails disposed in a fixed spaced relationship; and at least first and second vertical supports extending between the horizontal rails;

a plurality of spaced vertical wires between said first and second horizontal rails, each said vertical wire comprising:

a first end attached to one of the first and second horizontal rails;

a second end attached to a spring, wherein said spring applies a biasing force between the other of said first and second rails and said vertical wire to tension said vertical wire and allow the vertical wire to move upon a change in tension in the vertical wire;

a plurality of triggers, each individual trigger being associated with an individual one of said vertical sensor wires and being operable to move from a static position to a tripped position upon movement of said individual one of said vertical sensor wires; and at least one sensor operably connected to said plurality of triggers, wherein movement of said wires is identified by said sensor; wherein said at least one sensor comprises:

a first hinged strip that is adapted to move in a first direction upon any of said vertical wires being cut; and a second hinged strip that is adapted to move in a second direction upon any of said vertical wires being pulled.

9. The fencing system of claim 8, wherein said first and second hinged strips are connected to a switch, wherein movement of at least one trigger causes the switch to change the state of an electrical circuit.

10. The fencing system of claim 8, wherein said panel is disposed adjacent to another panel, and wherein one of said wires of each of said adjacent of panels is mechanically coupled to an adjacent panel so as to indicate movement of one of said panels relative to the other.

* * * * *